US007289743B2

(12) United States Patent
Kin et al.

(10) Patent No.: US 7,289,743 B2
(45) Date of Patent: Oct. 30, 2007

(54) IMAGE FORMING APPARATUS, A TONER COUNTER AND A CALCULATION METHOD OF TONER CONSUMPTION

(75) Inventors: Hidenori Kin, Nagano-ken (JP); Hidetsugu Shimura, Nagano-ken (JP); Takehiko Okamura, Nagano-ken (JP); Shinsuke Yokote, Nagano-ken (JP); Isao Inaba, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 11/036,885

(22) Filed: Jan. 13, 2005

(65) Prior Publication Data

US 2005/0169648 A1 Aug. 4, 2005

(30) Foreign Application Priority Data

| | | |
|---|---|---|
| Jan. 20, 2004 | (JP) | 2004-011394 |
| Jan. 26, 2004 | (JP) | 2004-016713 |
| Sep. 30, 2004 | (JP) | 2004-287301 |
| Sep. 30, 2004 | (JP) | 2004-287302 |
| Nov. 26, 2004 | (JP) | 2004-342154 |

(51) Int. Cl.
*G03G 15/08* (2006.01)
*G03G 15/00* (2006.01)

(52) U.S. Cl. ..... 399/27; 399/49

(58) Field of Classification Search ..... 399/27, 399/49

See application file for complete search history.

(56) References Cited

U.S. PATENT DOCUMENTS

| | | | | |
|---|---|---|---|---|
| 5,349,377 A | 9/1994 | Gilliland et al. | | |
| 5,724,627 A * | 3/1998 | Okuno et al. | | 399/27 |
| 6,871,026 B2 * | 3/2005 | Shimura et al. | | 399/12 |
| 2004/0042805 A1 * | 3/2004 | Takamatsu et al. | | 399/27 |
| 2005/0185973 A1 * | 8/2005 | Hama et al. | | 399/27 |
| 2006/0233559 A1 * | 10/2006 | Sugita et al. | | 399/27 |
| 2007/0058996 A1 * | 3/2007 | Sakita et al. | | 399/27 |

FOREIGN PATENT DOCUMENTS

| | | |
|---|---|---|
| EP | 0 587 172 | 3/1994 |
| EP | 587172 A1 * | 3/1994 |
| JP | 05-27597 | 2/1993 |
| JP | 06-242676 | 9/1994 |
| JP | 10-239978 | 9/1998 |
| JP | 2002-162800 | 6/2002 |
| JP | 2002-174929 | 6/2002 |
| JP | 2004-163553 | 6/2004 |

* cited by examiner

*Primary Examiner*—Anjan Deb
(74) *Attorney, Agent, or Firm*—Hogan & Hartson LLP

(57) ABSTRACT

Based on a video signal, a toner dot counter and an off dot counter detect a size of a toner dot portion to carry an adherent toner thereto and a size of an off dot portion not to carry an adherent toner, respectively. Reference is made to a look-up table based on the detection results, so as to retrieve a coefficient Kv corresponding to a combination of the sizes of the toner dot portion and the off dot portion. A count value Cdot given by the toner dot counter is multiplied by the coefficient Kv, while the resultant product is integrated by an accumulator. An integration value for an image of one page is multiplied by a coefficient K0 equivalent to a toner adhesion percentage of solid image. Thus is determined a toner consumption TC on the page image.

11 Claims, 37 Drawing Sheets

F I G. 8

| SIZE OF TONER DOT PORTION | CORRECTION COEFFICIENT | |
|---|---|---|
| | SYMBOL | NUMERICAL VALUE |
| LESS THAN 1U | K1 | 0.6 |
| 1U OR MORE AND LESS THAN 1.5U | K2 | 1.0 |
| 1.5U OR MORE AND LESS THAN 1.75U | K3 | 1.2 |
| 1.75U OR MORE AND LESS THAN 4.5U | K4 | 1.3 |
| 4.5U OR MORE | K5 | 1.0 |

SOLID IMAGE
(X=0)

1-ON 1-OFF IMAGE
(X=1)

1-ON 2-OFF IMAGE
(X=2)

SUB-SCAN
DIRECTION

MAIN SCAN DIRECTION

| OUTPUT FROM PATTERN DETERMINATION CIRCUIT | | | | | | | COUNT VALUE (C2n) |
|---|---|---|---|---|---|---|---|
| COUNTER TO RECEIVE OUTPUT | 21ST COUNTER | | | 1 | | | 1 |
| | 22ND COUNTER | | 2 | | | | 2 |
| | 23RD COUNTER | 3 | | 3 | | | 6 |
| | 24TH COUNTER | | | | | | 0 |
| | 25TH COUNTER | | | | | 5 | 5 |
| | 26TH COUNTER | | | | | | 0 |
| | 27TH COUNTER | | | | | | 0 |
| | 28TH COUNTER | | | | | | 0 |
| | 29TH COUNTER | | | | | | 0 |

FIG. 22

| SYMBOL | NUMERICAL VALUE |
|---|---|
| K0 | 13.0 [ng/DOT] |
| K21 | 0.67 |
| K22 | 0.93 |
| K23 | 0.92 |
| K24 | 0.93 |
| K25 | 0.94 |
| K26 | 0.95 |
| K27 | 0.96 |
| K28 | 0.96 |
| K29 | 0.96 |

FIG. 24

| SIZE OF OFF-DOT PORTION | SYMBOL | NUMERICAL VALUE |
|---|---|---|
| 0-0.5 DOTS | Ka | 0 |
| 0.5-1.5 DOTS | Kb | 0.67 |
| 1.5-2.5 DOTS | Kc | 0.93 |
| 2.5-4.5 DOTS | Kd | 0.92 |
| 4.5-6.5 DOTS | Ke | 0.94 |
| 6.5 DOTS OR MORE | Kf | 0.96 |

| OUTPUT FROM PATTERN DETERMINATION CIRCUIT | | | | | | | | | | | | | | | COUNT VALUE (C3n) |
|---|---|---|---|---|---|---|---|---|---|---|---|---|---|---|---|
| COUNTER TO RECEIVE OUTPUT | 31ST COUNTER | | | | | | 1 | | | | | | | | 1 |
| | 32ND COUNTER | | 1 | | | | | | | | | | | | 1 |
| | 33RD COUNTER | 1 | | | 1 | | | | | | | | | | 2 |
| | 34TH COUNTER | | | | | | | | | | | | | | 0 |
| | 35TH COUNTER | | | | | | | | | | 1 | | | | 1 |
| | 36TH COUNTER | | | | | | | | | | | | | | 0 |
| | 37TH COUNTER | | | | | | | | | | | | | | 0 |
| | 38TH COUNTER | | | | | | | | | | | | | | 0 |
| | 39TH COUNTER | | | | | | | | | | | | | | 0 |
| | CONSECUTIVE-DOTS COUNTER | | | | | 1 | | 1 | 1 | | | 1 | 1 | 1 | 6 |

FIG. 28

| SYMBOL | NUMERICAL VALUE |
|---|---|
| K0 | 13.0 [ng/DOT] |
| K30 | 1.0 |
| K31 | 1.5 |
| K32 | 1.16 |
| K33 | 1.31 |
| K34 | 1.4 |
| K35 | 1.5 |
| K36 | 1.6 |
| K37 | 1.69 |
| K38 | 1.69 |
| K39 | 1.69 |

FIG. 34

| Kv | | NUMBER OF CONSECUTIVE TONER DOTS | | | | | |
|---|---|---|---|---|---|---|---|
| | | 1 | 2 | 3 | 4 | 5~10 | 11~ |
| NUMBER OF CONSECU-TIVE OFF DOTS | 1 | 1.48 | 1.26 | 1.22 | 1.08 | 1.04 | 1.00 |
| | 2 | 1.17 | 1.22 | 1.09 | 1.09 | 1.04 | 1.00 |
| | 3 | 1.28 | 1.28 | 1.14 | 1.09 | 1.11 | 1.00 |
| | 4 | 1.41 | 1.31 | 1.20 | 1.16 | 1.09 | 1.00 |
| | 5~8 | 1.47 | 1.33 | 1.22 | 1.16 | 1.14 | 1.00 |
| | 9~10 | 1.62 | 1.48 | 1.31 | 1.23 | 1.20 | 1.00 |
| | 11~ | 1.65 | 1.50 | 1.38 | 1.30 | 1.21 | 1.00 |

803

IMAGE FORMING APPARATUS, A TONER COUNTER AND A CALCULATION METHOD OF TONER CONSUMPTION

CROSS REFERENCE TO RELATED APPLICATION

The disclosure of Japanese Patent Applications enumerated below including specifications, drawings and claims is incorporated herein by reference in its entirety:

No.2004-11394 filed on Jan. 20, 2004;
No.2004-16713 filed on Jan. 26, 2004;
No.2004-287301 filed on Sep. 30, 2004;
No.2004-287302 filed on Sep. 30, 2004; and
No.2004-342154 filed on Nov. 26, 2004.

BACKGROUND OF THE INVENTION

1. Field of the Invention

The present invention relates to a technique for calculating toner consumption in an image forming apparatus.

2. Description of the Related Art

In electrophotographic image forming apparatuses, such as printers, copiers and facsimiles, which form images using a toner, a need exists for figuring out toner consumption or residual quantity of toner as a matter of convenience for maintenance services such as toner replenishment. Particularly, the recent years have seen increasing demands for allowing a toner charged in the apparatus to be used as effectively as possible or with minimum toner waste, while exactly predicting time when the toner is used up, as well as for preventing the degradation of image quality as a result of shortage of the remaining toner. Hence, the image forming apparatuses of this type are faced with a demand for further increasing the accuracies of toner counting technique.

In response to such demands, there have heretofore been proposed techniques for accurately determining the toner consumption. According to a calculation method of toner consumption as disclosed in Japanese Patent Application Laid-Open Gazette No.2002-174929, for instance, determines the toner consumption in the following manner, noting a fact that a non-linear relation exists between the continuity of dots and the toner consumption. Print dot strings are classified into three patterns including isolated dots, consecutive double dots and intermediate-value dots. The number of generated dots in each of the patterns is counted so as to determine the toner consumption based on the resultant count value.

According to the prior-art technique, however, the unit of count is the number of "print dots", whereas the amount of toner adherent to the intermediate-value dots is calculated on assumption that an equal amount of toner is adhered to each of the dots. That is, the prior-art technique obviates close study on the amount of toner adherent to the respective types of print dots. As a result, the prior-art technique sometimes falls short of fully meeting the demand for even higher accuracies of the calculation of toner consumption.

SUMMARY OF THE INVENTION

The invention is directed to a further increase of the accuracy of the calculation of toner consumption in the image forming apparatus.

Hereinafter, the terms used herein are defined as below. A toner image is an assembly of a large number of dots. Each of the dots is either a "toner dot" which is to carry adherent toner thereon, or an "off-dot" which is not to carry the adherent toner thereon. In a microscopic view, the toner dot in the toner image either falls into a case where only a single toner dot exists as isolated, or is adjoined by no toner dot so as to be surrounded by the off-dots, or a case where plural toner dots exist in consecution to form a sub-assembly of toner dots. The off-dot is also defined the same way.

According to the present specification, each of the dots which are to carry the adherent toner thereon is referred to as the "toner dot" whereas each of the dots which are not to carry the adherent toner thereon is referred to as the "off-dot". It is noted that in a case where the dot is simply called "dot", a particular distinction is not made between the toner dot and the off-dot. In addition, a sub-assembly consisting of one toner dot or plural consecutive toner dots is referred to as a "toner dot portion". Likewise, a sub-assembly consisting of one off-dot or plural consecutive off-dots is referred to as an "off-dot portion".

The inventors conducted an experiment wherein images of various patterns were formed by varying the size of a toner dot portion to be formed and the distance between adjoining toner dot portions, whereas measurement was taken on the amount of toner consumed for forming each of the images of the various patterns. The experiment results revealed a fact that the toner consumptions on the individual toner dot portions vary in a complicated manner according to the varied sizes of the toner dot portions and/or the varied distances between the toner dot portion of interest and another toner dot portion adjacent thereto. That is, the amount of toner consumed for forming each of the toner dot portions is affected by both the size of the toner dot portion of interest and/or the size of an off dot portion neighboring the toner dot portion of interest.

In a first aspect of the invention, the technique for calculating the toner consumption is arranged to achieve the above object from a viewpoint that toner adhesion per unit area varies depending upon the size of the toner dot portion. The toner consumption is calculated based on the size of the toner dot portion and on a toner adhesion characteristic previously determined for each of the sizes thereof.

In a second aspect of the invention, the technique for calculating the toner consumption is arranged to achieve the above object from a viewpoint that the amount of toner adherent to a toner dot portion varies depending upon the distance between the toner dot portion of interest and another toner dot portion. The toner consumption is calculated based on the size of the off-dot portion formed between the toner dot portions. The techniques according the first and second aspects of the invention provide the high-accuracy determination of the toner consumption.

Further, in a third aspect of the invention, the toner consumption is calculated, giving consideration to both of the sizes of the toner dot portion and the off dot portion which constitute the toner image. Therefore, the invention also provides an ability to calculate the toner consumption more accurately than the conventional toner counting techniques wherein only the continuity of the toner dots or the size of the toner dot portion is taken into consideration.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 8 and FIG. 9 are drawings each illustrating the correction coefficient for each of the toner dot portions;

FIG. 22 is a table showing an example of the coefficients for the toner counter of the third embodiment;

FIG. 24 shows an exemplary modification of the toner counter of the third embodiment;

FIG. 28 is a table showing an example of the coefficients for the toner counter of the fourth embodiment;

FIG. 34 is a chart showing one example of contents of the look-up table;

DETAILED DESCRIPTION OF THE PREFERRED EMBODIMENTS

Now, description will hereinbelow be made on specific embodiments of image forming apparatuses to which toner counting techniques according to the invention are applied. These embodiments are common in a basic construction of the image forming apparatuses, provided that the embodiments individually adopt different calculation methods of toner consumption and different arrangements to carry out the calculation methods. First of all, therefore, the basic construction of the apparatuses common to the embodiments will be described and then, description will be made on the toner counting techniques according to the embodiments.

1. Basic Construction of the Apparatus

Figure 1:
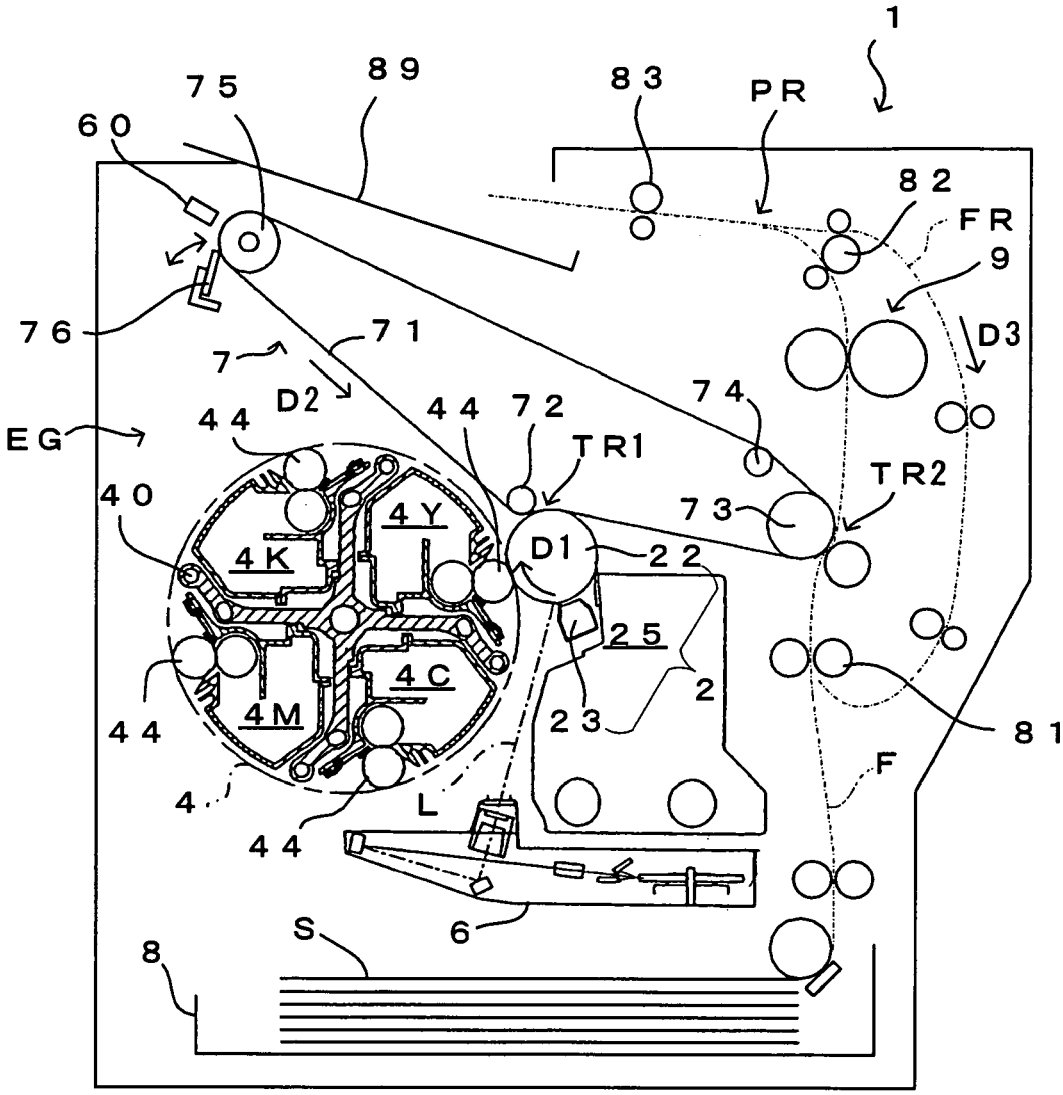
FIG. 1 is a drawing which shows the structure of an image forming apparatus according to the present invention.
Figure 2:
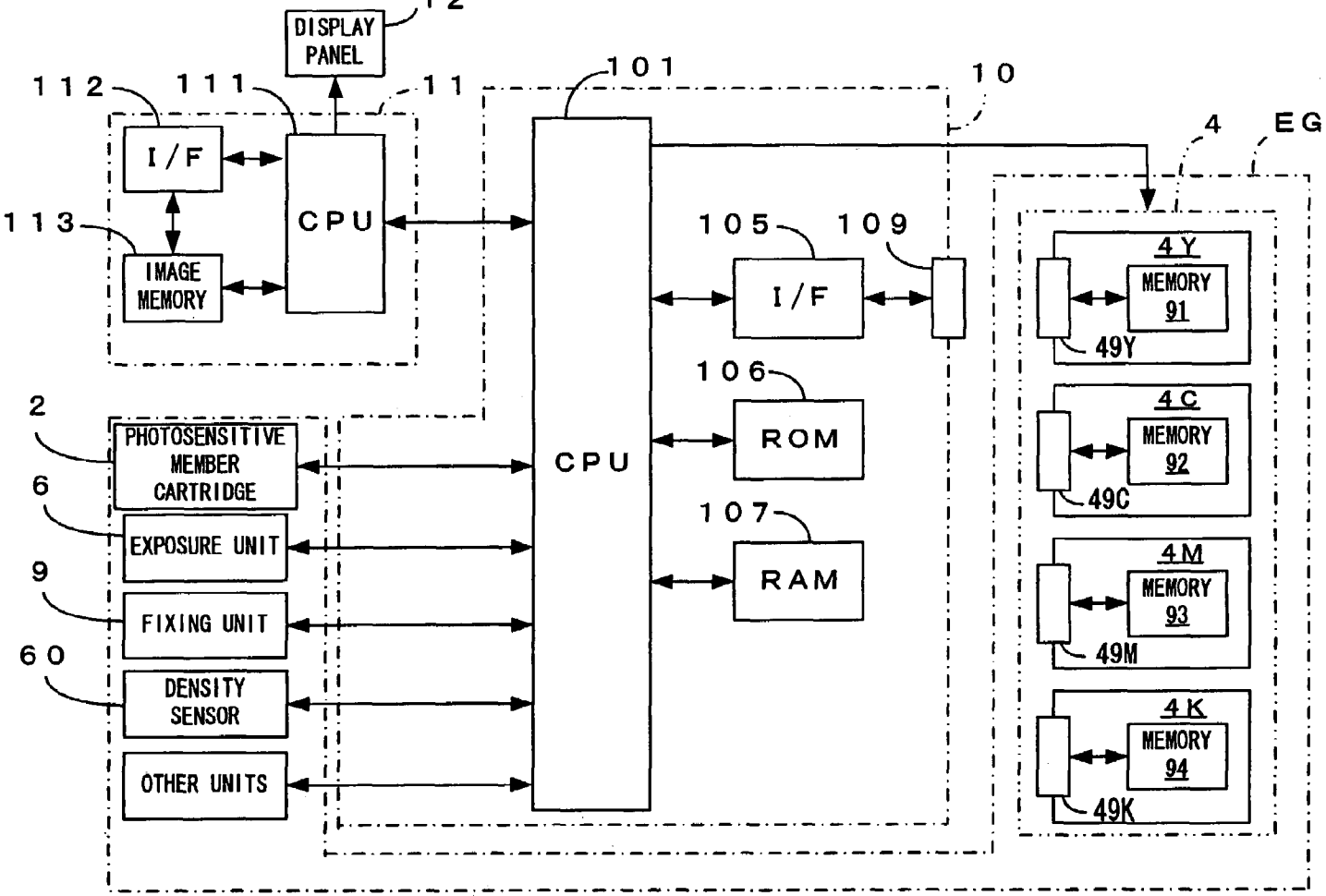
FIG. 2 is a block diagram of the electric structure of the image forming apparatus which is shown in FIG. 1.

FIG. 1 is a drawing which shows the structure of an image forming apparatus according to the present invention. FIG. 2 is a block diagram of the electric structure of the image forming apparatus which is shown in FIG. 1. The illustrated apparatus 1 is an apparatus which overlays toner in four colors of yellow (Y), cyan (C), magenta (M) and black (K) one atop the other and accordingly forms a full-color image, or forms a monochrome image using only black toner (K). In the image forming apparatus 1, when an image signal is fed to a main controller 11 from an external apparatus such as a host computer, a predetermined image forming operation is performed. That is, an engine controller 10 controls respective portions of an engine part EG in accordance with an instruction received from the main controller 11, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus 1 as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

Non-volatile memories 91 through 94 which store information regarding the respective developers are disposed to the developers 4Y, 4C, 4M and 4K. As one of connectors 49Y, 49C, 49M and 49K disposed to the respective developers selected as needed is connected with a connector 109 which is disposed to the main section, a CPU 101 of the engine controller 10 and one of the memories 91 through 94 communicate with each other. In this manner, the information regarding the respective developers is transmitted to the CPU 101 and the information inside the respective memories 91 through 94 is updated and stored.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there are a density sensor 60 and a cleaner 76 in the vicinity of the roller 75. The density sensor 60 optically detects a toner amount which constitutes a toner image which is formed as a patch image on the intermediate transfer belt 71 when needed. The density sensor 60 irradiates light toward the patch image, receives reflection light from the patch image, and outputs a signal corresponding to a reflection light amount.

The cleaner 76 can be attached to and detached from the intermediate transfer belt 71. When abutting on the intermediate transfer belt 71 as needed, the cleaner 76 scrapes off the toner remaining on the intermediate transfer belt 71 and the toner which constitutes the patch image.

Further, as shown in FIG. 2, the apparatus 1 comprises a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, etc.

In FIG. 2, denoted at 113 is an image memory which is disposed to the main controller 11, so as to store an image which is fed from an external apparatus such as a host computer via an interface 112. Denoted at 106 is a ROM which stores a calculation program executed by the CPU 101, control data for control of the engine part EG, etc. Denoted at 107 is a memory (RAM) which temporarily stores a calculation result derived by the CPU 101, other data, etc.

The memories 91 through 94 disposed to the developers 4Y, 4C, 4M and 4K are preferably non-volatile memories which are capable of holding data even when the power source is off or the developers are detached from the main section. As such non-volatile memories, flash memories, ferroelectric memories (FRAMs), EEPROMs or the like may be used.

Figure 3:
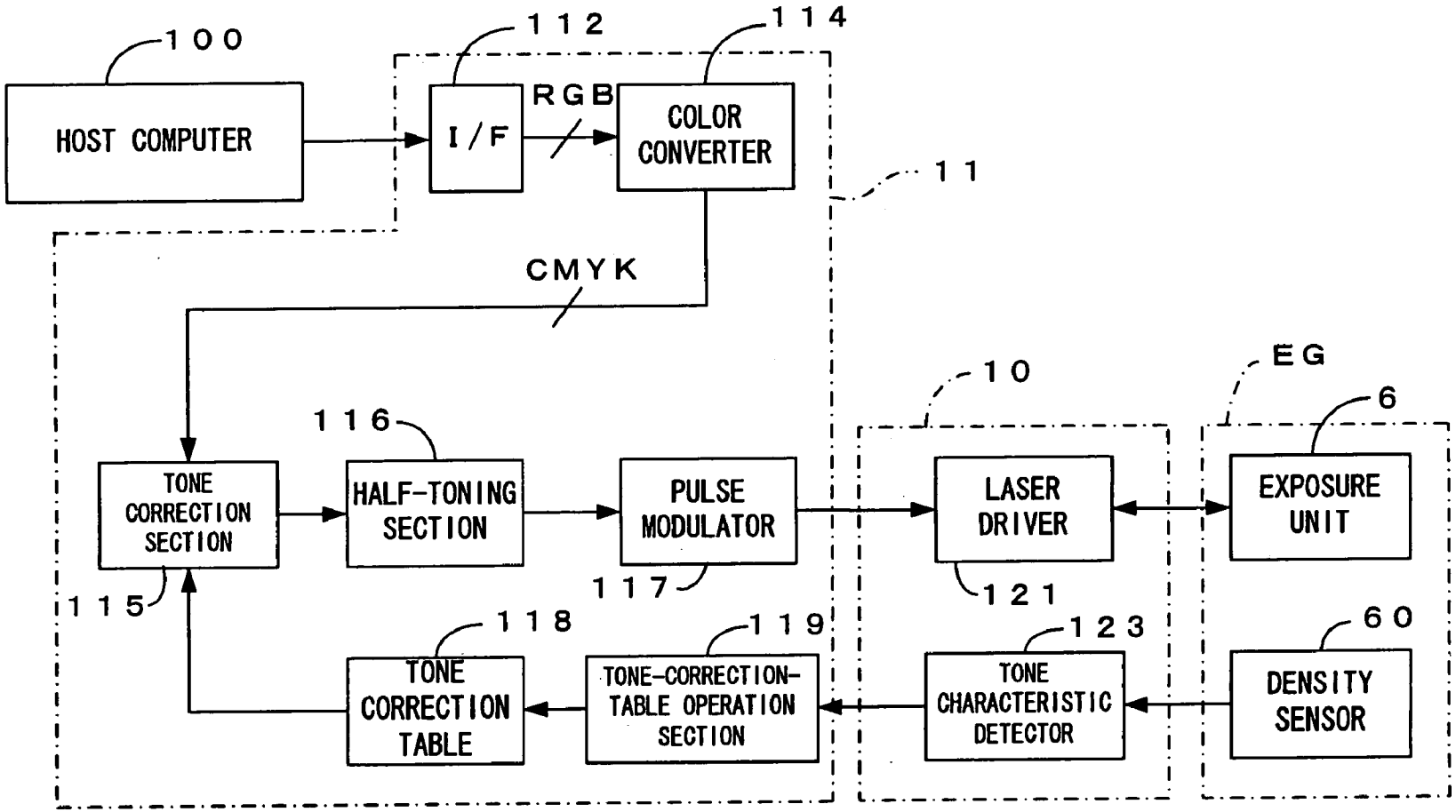
FIG. 3 is a diagram showing signal processing blocks of the apparatus.

FIG. 3 is a diagram showing signal processing blocks of the apparatus. The image forming apparatus operates as follows. When an image signal is inputted from an external apparatus such as a host computer 100, the main controller 11 performs a predetermined signal processing on the input image signal. The main controller 11 includes function blocks such as a color converter 114, a tone correction section 115, a half-toning section 116, a pulse modulator 117, a tone correction table 118, a tone-correction-table operation section 119.

In addition to the CPU 101, the ROM 106, and the RAM 107 shown in FIG. 2, the engine controller 10 further includes a laser driver 121 for driving a laser light source provided at the exposure unit 6, and a tone characteristic detector 123 for detecting a tone characteristic based on a detection result given by the density sensor 60, the tone characteristic representing a gamma characteristic of the engine EG.

In the main controller 11 and the engine controller 10, the function blocks may be implemented in hardware or otherwise, in software executed by the CPU 111, 101.

In the main controller 11 supplied with the image signal from the host computer 100, the color converter 114 converts RGB color data into CMYK color data, the RGB color data representing tone levels of RGB components of each pixel in an image corresponding to the image signal, the CMYK color data representing tone levels of CMYK components corresponding to the RGB components. In the color converter 114, the input RGB color data comprise 8 bits per color component for each pixel (or representing 256 tone levels), for example, whereas the output CMYK color data similarly comprise 8 bits per color component for each pixel (or representing 256 tone levels). The CMYK tone data outputted from the color converter 114 are inputted to the tone correction section 115.

The tone correction section 115 performs tone correction on the per-pixel CMYK data inputted from the color converter 114. Specifically, the tone correction section 115 refers to the tone correction table 118 previously stored in the non-volatile memory, and converts the per-pixel CMYK data inputted from the color converter 114 into corrected CMYK data according to the tone correction table 118, the corrected CMYK data representing corrected tone levels. An object of the tone correction is to compensate for the variations of the gamma characteristic of the engine EG constructed as described above, thereby allowing the image forming apparatus to maintain the overall gamma characteristic thereof in an idealistic state at all times.

The corrected CMYK tone data thus obtained are inputted to the half-toning section 116. The half-toning section 116 performs a half-toning process, such as an error diffusion process, a dithering process or a screening process, and then supplies the pulse modulator 117 with the half-toned CMYK tone data comprising 8 bits per color component for each pixel. The content of the half-toning process varies depending upon the type of an image to be formed. A process of the most suited content for the image is selected based on judgment standards according to which the subject image is classified as any one of a monochromatic image, a color image, a line drawing and a graphic image. Then, the selected process is executed.

The half-toned CMYK tone data inputted to the pulse modulator 117 are represented by a multivalued signal which indicates respective sizes and arrays of CMYK toner dots, to which CMYK color toners are made to adhere and which constitute one pixel. Based on such half-toned CMYK tone data thus received, the pulse modulator 117 generates a video signal for pulse width modulation of an exposure laser pulse for forming each of CMYK color images, the exposure laser provided at the engine EG. Then, the resultant signal is outputted to the engine controller 10 via a video interface not shown. In response to the video signal, the laser driver 121 provides ON/OFF control of a semiconductor laser of the exposure unit 6 whereby an electrostatic latent image of each of the color components is formed on the photosensitive member 22. The image corresponding to the image signal is formed in this manner.

In the image forming apparatuses of this type, the gamma characteristic varies from apparatus to apparatus. Furthermore, the apparatus per se encounters the variations of the gamma characteristic thereof according to the use conditions thereof. In order to eliminate the influences of the varied gamma characteristics on the image quality, a tone control process is performed in a predetermined timing so as to update the contents of the tone correction table 118 based on measurement results of image density.

The tone control process is performed as follows. Toned patch images for tone correction, prepared for measurement of the gamma characteristic, are formed on the intermediate transfer belt 71 by means of the engine EG. A density of each of the toned patch images is detected by the density sensor 60. Based on signals from the density sensor 60, the tone characteristic detector 123 generates a tone characteristic (the gamma characteristic of the engine EG) which relate the individual tone levels of the toned patch images with the detected image densities. The resultant tone characteristic is outputted to the tone-correction table operation section 119 of the main controller 11. The tone-correction table operation section 119, in turn, operates tone correction table data based on the tone characteristic supplied from the tone characteristic detector 123. The tone correction table data are used for compensating for the measured tone characteristic of the engine EG in order to obtain an idealistic tone characteristic. Then, the tone-correction table operation section 119 updates the tone correction table 118 to the operation results. The tone correction table 118 is re-defined in this manner. Thus, the image forming apparatus is allowed to form images of a consistent quality regardless of the variations of the gamma characteristic thereof or the time-related variations thereof.

Now, a section-by-section description will be made on the toner counting techniques according to the first through sixth embodiments of the invention which are applicable to the image forming apparatus of the aforementioned construction. It is noted that both a dot counter and a toner counter, which will be described hereinafter, may be implemented in hardware employing a gate array and discrete devices, or in software executed by a CPU or a dedicated processor or otherwise, have an arrangement combining the above two arrangements.

2-1. Basic Principles of First and Second Embodiments

The toner image is formed of a plurality of toner dots. The overall toner consumption may be determined by adding up all the amounts of toner consumed for forming all of the toner dots. It is noted however that the image forming apparatus of this type has a non-linear relation between the dot size and the toner adhesion, as will be described hereinlater. It is therefore impossible to determine the toner consumption with high accuracies simply by integrating the dot sizes or the number of dots. The present inventors focused attention on a phenomenon that the toner locally adheres to an end portion of the toner dot in high density (edge effect). The inventors have found that the high-accuracy determination of the toner consumption can be accomplished by introducing a calculation method of toner consumption, which takes the effect into consideration.

Figure 4:
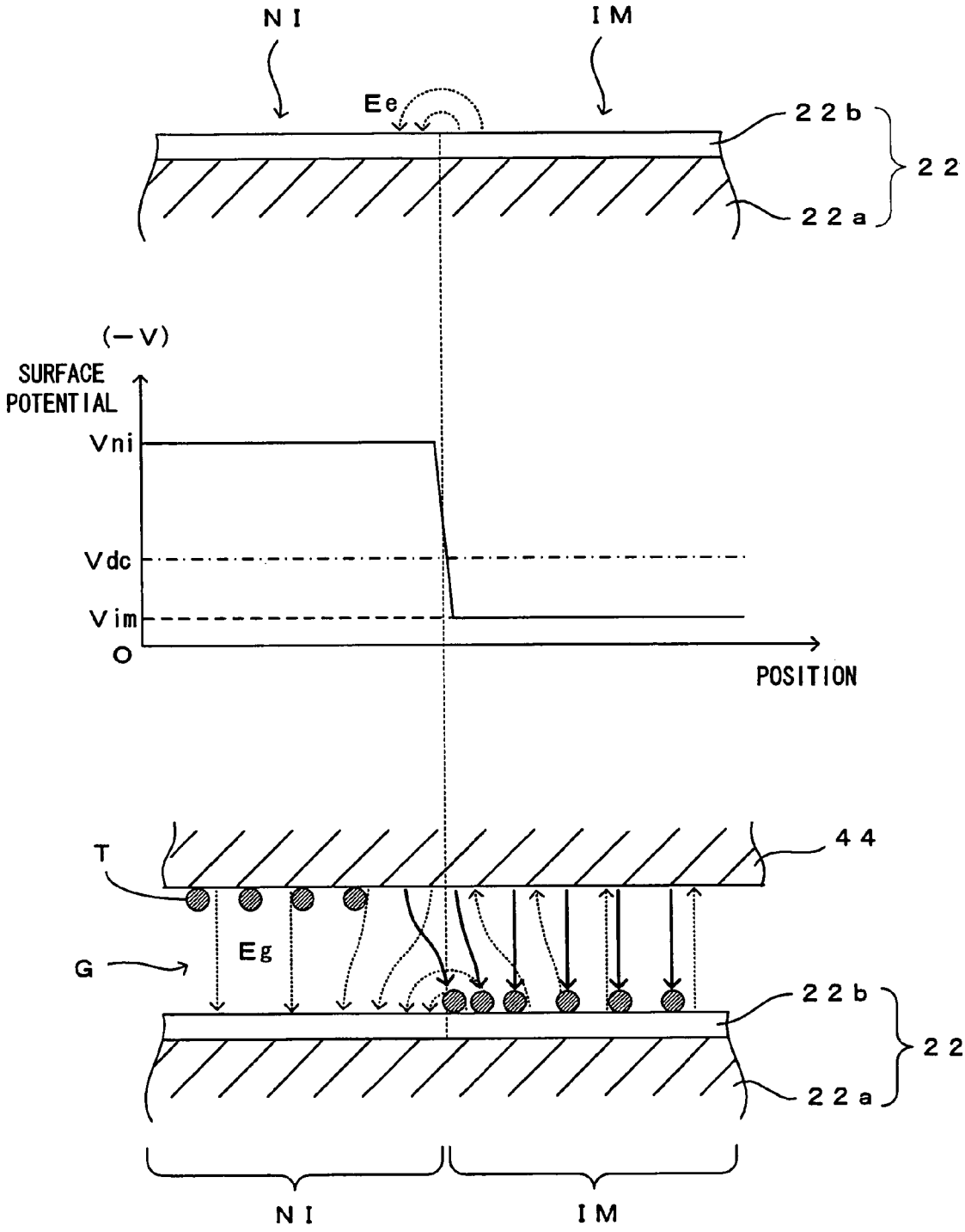
FIG. 4 is a diagram for explaining the variations of toner density caused by the edge effect.

FIG. 4 is a diagram for explaining the variations of toner density caused by the edge effect. As shown in an upper part of FIG. 4, the photosensitive member 22 includes a cylindrical base 22*a*, and a surface layer 22*b* formed from a photosensitive material over a surface thereof. On a surface of the photosensitive member 22 carrying thereon an electrostatic latent image, the surface potential thereof differs between an image area IM to which the toner is to be made to adhere and a non-image area NI to which the toner is not made to adhere. Specifically, the surface of the photosensitive member 22 is charged by the charger unit 23 (FIG. 1) to a substantially even potential. Of the surface area, only the image area IM is exposed to the scanned light beam L from the exposure unit 6 (FIG. 1) so as to form the electrostatic latent image thereon. Consequently, the surface potential at the non-image area NI is maintained at a non-image area potential Vni which is substantially equal to the initial surface potential, whereas the surface potential at the image area IM is decreased to almost zero or an image area potential Vim. Hence, the surface potential is sharply fluctuated in the neighborhood of a boundary between the image area IM and the non-image area NI so as to produce a locally intense electric field Ee at this portion.

Let us consider a case where the photosensitive member 22 in this state is confronted by the developing roller 44 via a gap G therebetween, as shown in a lower part of FIG. 4. The developing roller 44 carries thereon a negative charge toner and is applied with a developing bias voltage having an average value Vdc. The surface potential of the photosensitive member 22 cooperates with the developing bias applied to the developing roller 44 to produce in the gap G an electric field Eg indicated by broken arrows in the lower part of FIG. 4. Out of the toner T carried on the developing roller 44, some toner carried on an area thereof corresponding to the image area IM of the photosensitive member 22 is transferred to the photosensitive member 22 (indicated by solid arrows) because of the action of the electric field Eg. On the other hand, the toner on an area corresponding to the non-image area NI of the photosensitive member 22 remains on the developing roller 44. However, the toner on an area corresponding to the boundary between the image area IM and the non-image area NI is drawn by the local electric field Ee so as to be made to adhere to the end portion of the image area IM. Accordingly, the toner adheres to the end portion of the image area IM in higher density than to the other portion of the image area IM. In this manner, the end portion of the image area IM encounters the "edge effect" wherein the toner adheres thereto in higher density than to the other portion of the image area.

Figure 5:
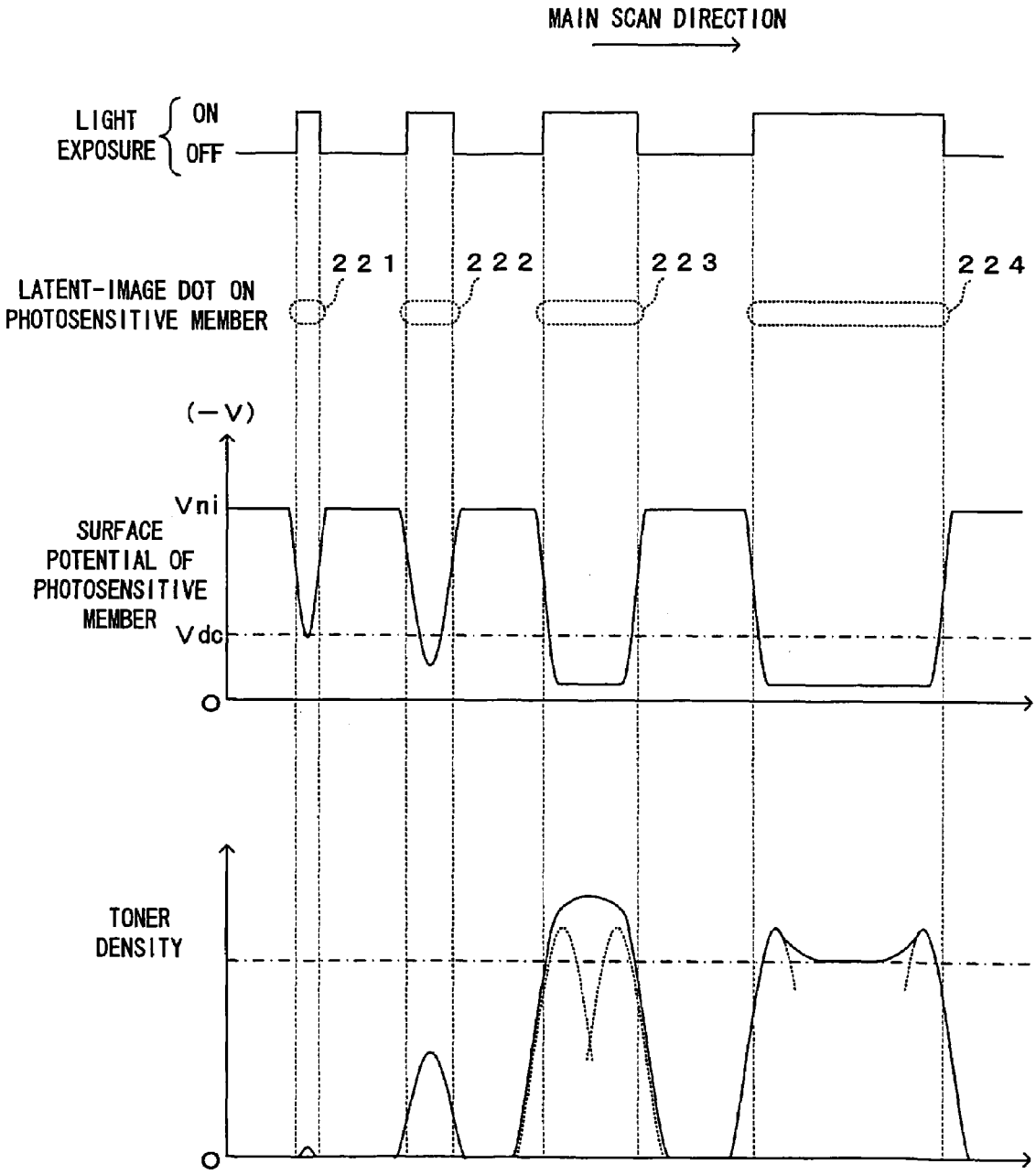
FIG. 5 is a chart showing a relation between the dot size and the toner density.

FIG. 5 is a chart showing a relation between the dot size and the toner density. By way of off-and-on exposure of the surface of the photosensitive member 22 to the scanned light beam L, formed on the photosensitive member 22 is a latent-image dot region equivalent to the image area which is to carry adherent toner thereon. The length of the latent-image dot region with respect to a scan direction (main scan direction) of the light beam L is increased with the increase of the length of continuous irradiation time of the light beam L. In a case where four exposure processes are carried out with the continuous irradiation time varied each time, as shown in FIG. 5, there are formed latent-image dot regions 221 to 224 individually having lengths corresponding to the respective continuous irradiation times. In the relatively short latent-image dot region 221, a well of potential on the surface of the photosensitive member 22 has a shallow depth and a narrow width. As the latent-image dot region becomes longer, the well of potential is accordingly increased in width. However, the depth of the potential well becomes substantially constant after increased to some extent.

When the developing bias voltage having the average value Vdc is applied to the developing roller 44 brought into the face-to-face relation with the photosensitive member 22 thus formed with the latent-image dot regions, the toner is made to adhere thereto in an amount corresponding to a depth and a length of each of the latent-image dot regions. A small amount of toner adheres to the small latent-image dot region 221 because the well of potential thereof is shallow and narrow in width. The amount of adhered toner is increased as the latent-image dot region is increased in size. An inner portion of the longest latent-image dot region 224 has a substantially constant toner density. However, the toner adheres to the end portions of the dot region 224 in higher density than in the inner portion thereof due to the edge effect. The latent-image dot region 223 having a certain length allows the toner to adhere to the overall area thereof in a particularly high density because of a synergistic result of the edge effect increasing the amount of toner adhered to the opposite end portions thereof.

Thus, the latent-image dot regions of different sizes do not simply have different areas, but have individually different densities of the adherent toner in accordance with the sizes thereof. If the toner density were constant, the amount of toner adherent to the overall dot region could be determined by multiplying the area of the dot region by a proportionality constant which is equivalent to the toner density. In actual fact, however, the toner density is not consistent, as described above. It is impossible for such a method to determine the toner consumption accurately. In view of this, the following approach may preferably be taken. A toner adhesion characteristic representing a relation between the size of the toner dot portion and the toner adhesion is previously determined and quantified. The amount of toner consumed to form a toner dot portion is calculated as referring the size of the toner dot portion of interest to the toner adhesion characteristic.

Figure 6:
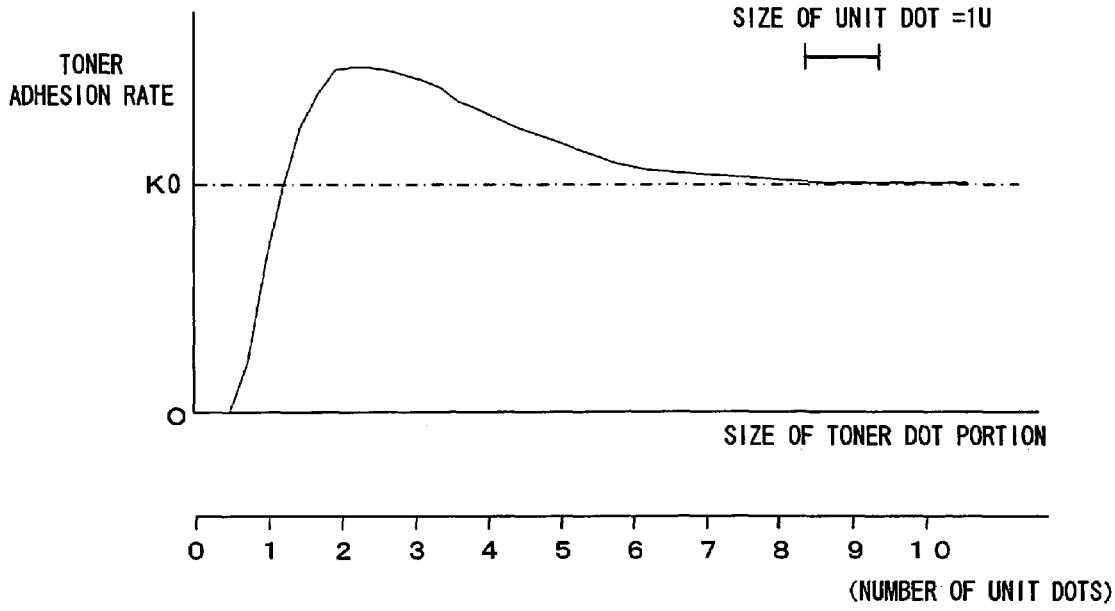
FIG. 6 is a graph showing an example of the toner adhesion characteristic.

FIG. 6 is a graph showing an example of the toner adhesion characteristic. In FIG. 6, the size of the toner dot portion (the length of the latent-image dot portion with respect to the main scan direction) is plotted on the abscissa, and the toner adhesion rate per size is plotted on the ordinate. The toner adhesion rate is a quotient given by dividing the amount of toner adhered to the overall toner dot portion by the area of the toner dot portion. As mentioned supra, the toner dot portion of a smaller size has a smaller amount of toner adhered thereto and hence, has a lower toner adhesion rate. While the toner adhesion rate increases with increase in the size of the toner dot portion, the toner adhesion rate reaches the maximum value in association with a certain size of the toner dot portion. As the size of the toner dot portion is further increased, the toner adhesion rate is progressively decreased toward a certain value K0. The reason why the toner dot portion of the larger size is decreased in the toner adhesion rate is that the end portion having the higher toner density due to the edge effect is decreased in the proportion to the overall area of the toner dot portion.

In the image forming apparatus, the maximum toner adhesion rate was observed in a toner dot portion of a 2 U size which is equivalent to about two unit dots, as shown in FIG. 6, provided that the unit dot is defined by an isolated dot having a tone level of 100% (equivalent to a unit pixel which is not involved in half-tone reproduction) and that the length of the unit dot is defined as 1 U.

Based on the relation (equivalent to the toner adhesion characteristic) between the size of the toner dot portion and the toner adhesion rate thus determined, the amount of toner consumed for visualizing each toner dot portion may be determined by multiplying the size of the dot region by the toner adhesion rate thereof. The size of a toner dot portion to be formed can be known from a video signal which is supplied from the main controller 11 to the engine controller 10 and which decides a length of the continuous irradiation time of the exposure beam L irradiated on the photosensitive member 22. Therefore, information indicative of the toner adhesion rate for each size of the toner dot portion may previously be stored in the memory such that the toner consumption on the toner dot portion of interest may be calculated using such information.

2-2. First Embodiment

Figure 7:
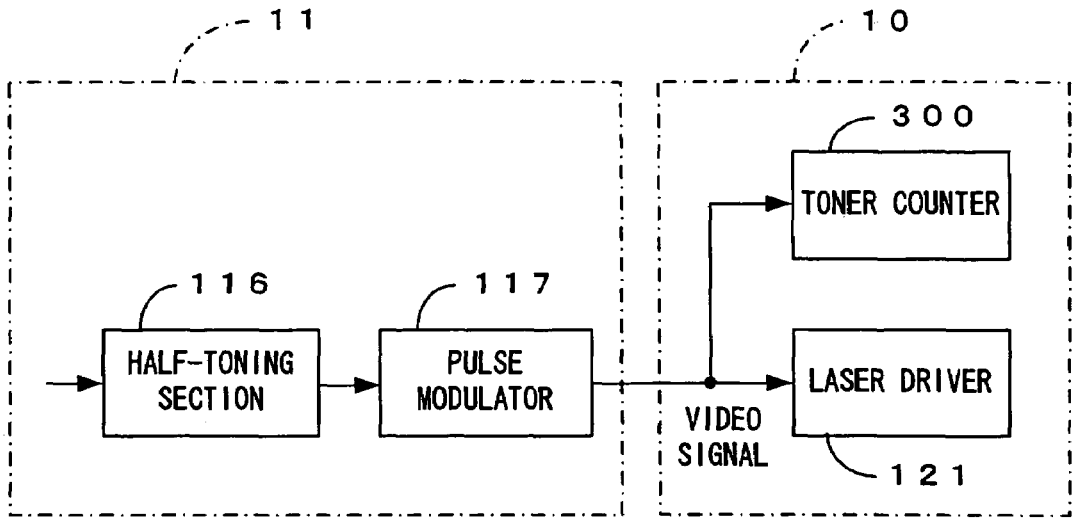
FIG. 7 is a block diagram showing a toner counter according to the first embodiment.

FIG. 7 is a block diagram showing a toner counter according to the first embodiment. In the image forming apparatus according to the first embodiment, the engine controller 10 includes a toner counter 300 for calculating the toner consumption based on the video signal supplied from the main controller 11 to the engine controller 10, as shown in FIG. 7.

The size of the toner dot portion may take various values depending upon the type of image to be formed or the content of the signal processing carried out by the main controller 11. If all the toner adhesion rates corresponding to all the possible sizes of the toner dot portions are to be tabulated and stored, an enormous amount of information must be stored. In order to calculate the toner consumption with reference to the table on a per-dot basis, a complicated and high-speed processing is required. It is therefore practicable to approximate the toner adhesion characteristic to a polygonal line or some kind of functional curve or to simplify the table, thereby reducing the amount of information for simplified processing.

The toner counter 300 of this embodiment is designed to simplify the table by classifying the sizes of the toner dot portions into some groups and regarding the toner dot portions in each group to have a given toner adhesion rate. Specifically, a toner dot portion to be formed is judged based on the video signal outputted from the main controller and is classified by the length thereof into any of the five groups. Then, a "correction coefficient" equivalent to a deviation from the standard toner adhesion rate K0 is defined for each of the groups. A more specific calculation method using this correction coefficient is described with reference to FIG. 8, FIG. 9 and FIG. 10.

Figure 9:
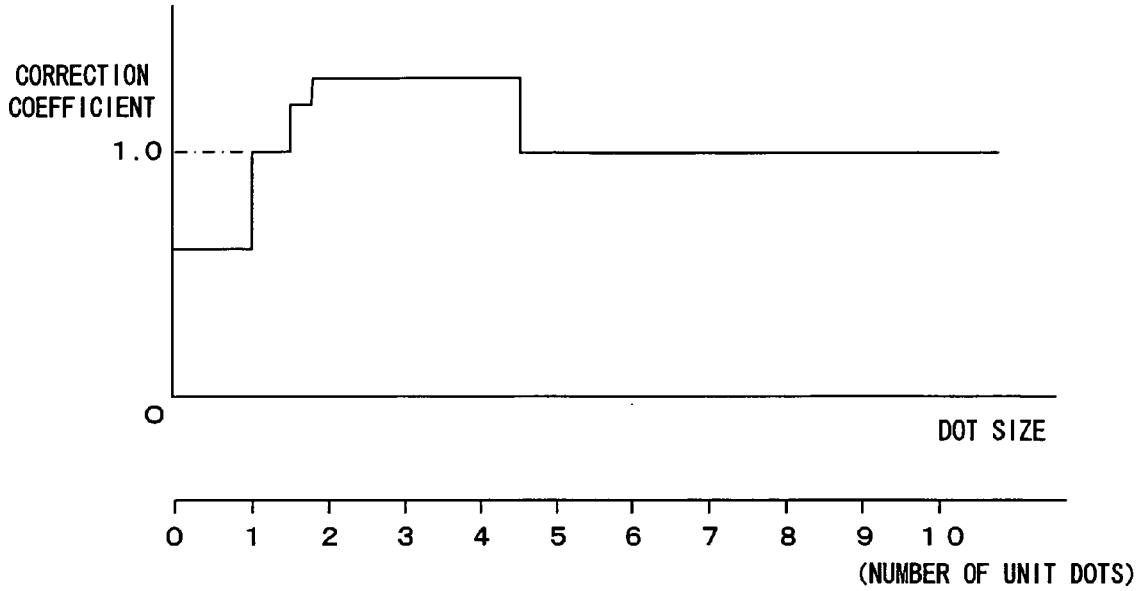

FIG. 8 and FIG. 9 each illustrate the correction coefficient for each of the toner dot portions. As shown in FIG. 8, the sizes of the toner dot portions (converted to sizes based on unit dot) are classified into five groups, to which correction coefficients K1 to K5 are assigned, respectively. Thus is obtained a step-like polygonal line shown in FIG. 9. This polygonal line is equivalent to a representation implemented by normalizing the toner adhesion characteristic curve of FIG. 6 by the toner adhesion rate K0 and quantizing the normalized values. The amount of information to be tabulated can be drastically reduced by approximating the toner adhesion characteristic in this manner. On the other hand, the same correction coefficient is applied to any of the dot portions classified into the same group. This permits the lengths of the dot regions classified into the same group to be simply integrated, as will be described hereinlater. As a result, the processing is also simplified.

Figure 10:
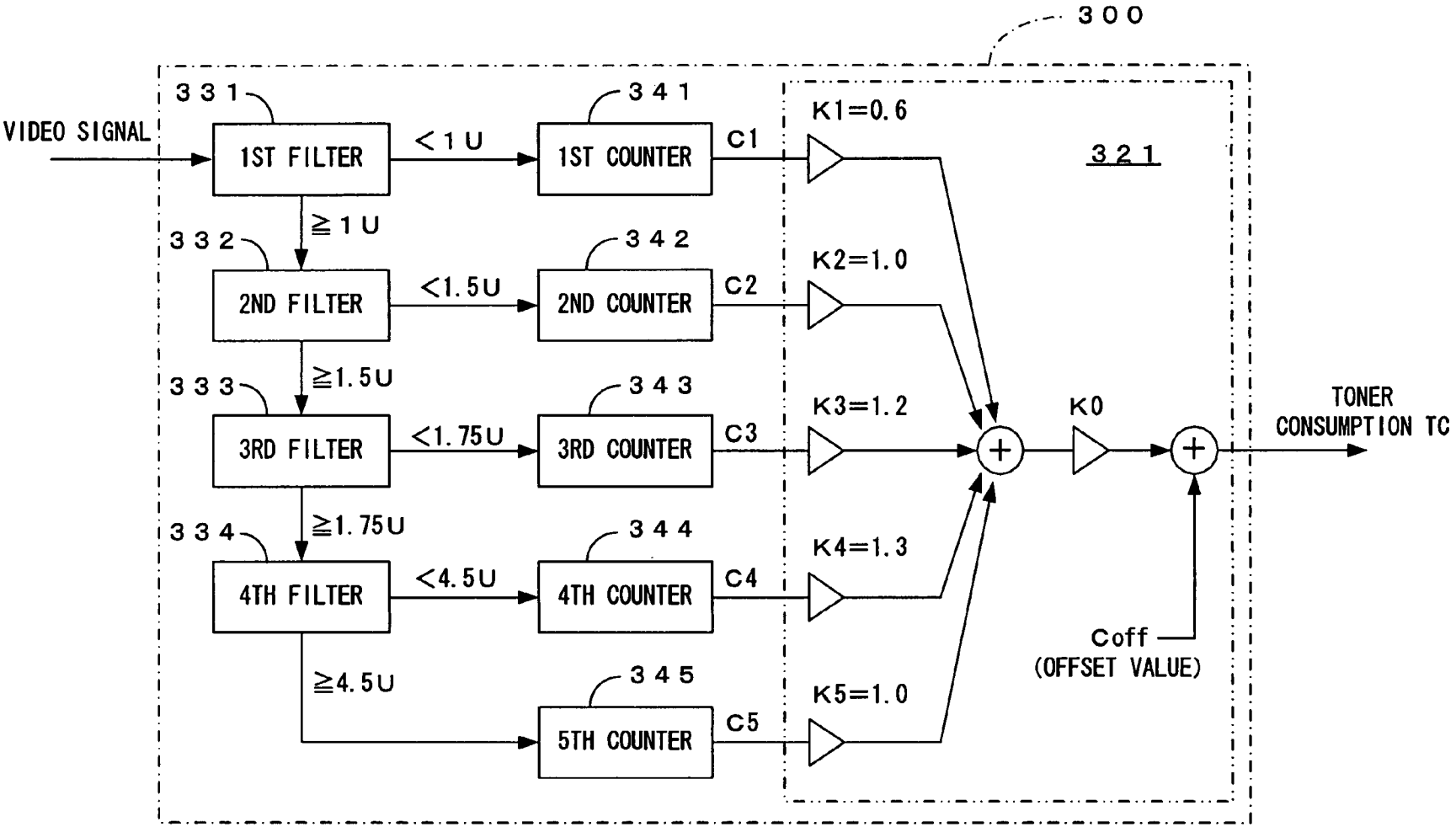
FIG. 10 is a signal flow chart showing an arrangement of the toner counter according to the first embodiment.

FIG. 10 is a signal flow chart showing an arrangement of the toner counter according to the first embodiment. First through fourth filters 331 through 334 are filters for classifying individual toner dot portions represented by input video signals based on the lengths thereof. If the video signal is a PWM signal, for example, the pulse width thereof indicates the length of the toner dot portion. First through fifth counters 341 through 345 are counters for integrating the length of the toner dot portion indicated by the input signal. An input video signal to the toner counter 300 is inputted to the first filter 331. If a pulse width of the input video signal indicates that a toner dot portion has a length of less than 1 U, the first filter 331 outputs the pulse to the first counter 341 on the right-hand side thereof. If the video signal represents a dot portion having a length of not less than 1 U, the first filter outputs the signal to the second filter 332 on the downward side.

In a similar manner, the second filter 332, the third filter 333 and the fourth filter 334 output signals indicative of toner dot portions having the lengths of less than 1.5 U, 1.75 U and 4.5 U to their right-hand sides, respectively. Furthermore, the second filter 332, the third filter 333 and the fourth filter 334 output signals indicative of toner dot portions having the lengths of not more than 1.5 U, 1.75 U and 4.5 U to the downward sides in the figure, respectively. Thus, each of the toner dot portions represented by the input video signals is classified by its size into any of the five groups.

Receiving a signal from the first filter 331, the first counter 341 integrates a length of a toner dot portion indicated by the received signal. Accordingly, the first counter 341 sequentially integrates the individual lengths of dot portions less than 1 U, the dot portions included in toner dot portions to be formed. Likewise, the second to the fourth counters 342 to 344 receive signals from the second to the fourth filters 332 through 334 respectively, and each integrate a length of a toner dot portion indicated by the received signal. That is, the second counter 342 integrates the lengths of toner dot portions not less than 1 U and less than 1.5 U; the third counter 343 integrating the lengths of toner dot portions not less than 1.5 U and less than 1.75 U; the fourth counter 344 integrating the lengths of toner dot portions not less than 1.75 U and less than 4.5 U. On the other hand, the fifth counter 345 integrates the lengths of toner dot portions not less than 4.5 U, based on signals outputted downwardly from the fourth filter 234. In this manner, each of the toner dot portions constituting a toner image is classified by its length into any of the groups, while the length of the toner dot portion so classified is integrated.

The engine controller 10 issues a command to the toner counter 300 periodically, or in a predetermined timing (for example, at regular time intervals or each time the number of formed images reaches a predetermined value). When the engine controller 10 applies the command to the toner counter 300, the individual counters 341 through 345 output respective counts C1 through C5 taken in the present time period to an operation section 321. The count C1 outputted from the first counter 341, for example, represents a value given by adding up all the lengths of toner dot portions less than 1 U, which are included in the toner dot portions formed during the period of interest.

The operation section 321, in turn, multiplies each of the counts C1 through C5 by each of the aforementioned correction coefficients K1 through K5. This compensates for the deviations of the toner adhesion rates associated with the varied sizes of the toner dot portions. Then, the individual products are summed up. The resultant sum is multiplied by the toner adhesion percentage K0. Then, the offset value Coff is added to the resultant product, thereby obtaining a final toner consumption TC in the period of interest. That is, the toner consumption TC is calculated using the following equation:

$$TC=K0\cdot(K1\cdot C1+K2\cdot C2+K3\cdot C3+K4\cdot C4+K5\cdot C5)+\mathrm{Coff} \quad \text{(Equation 1).}$$

In the equation, the offset value Coff is a value corresponding to an amount of toner consumed in a manner not to contribute to the formation of the toner image.

Such a toner is exemplified by toner liberated from the developing roller 44 so as to be adhered to the photosensitive member 22 to produce fogging or to be scattered in the apparatus, toner consumed by the apparatus during a control operation for maintaining the performance of the apparatus, and such. The amount of toner consumed in this manner is correlated with the length of operation time of the apparatus, the number of formed images, the operating conditions of the apparatus or the like. Hence, the amount of toner consumed during a period of interest is estimated from such information pieces managed by the engine controller 10 and the resultant estimation is used as the offset value Coff.

Figure 11:
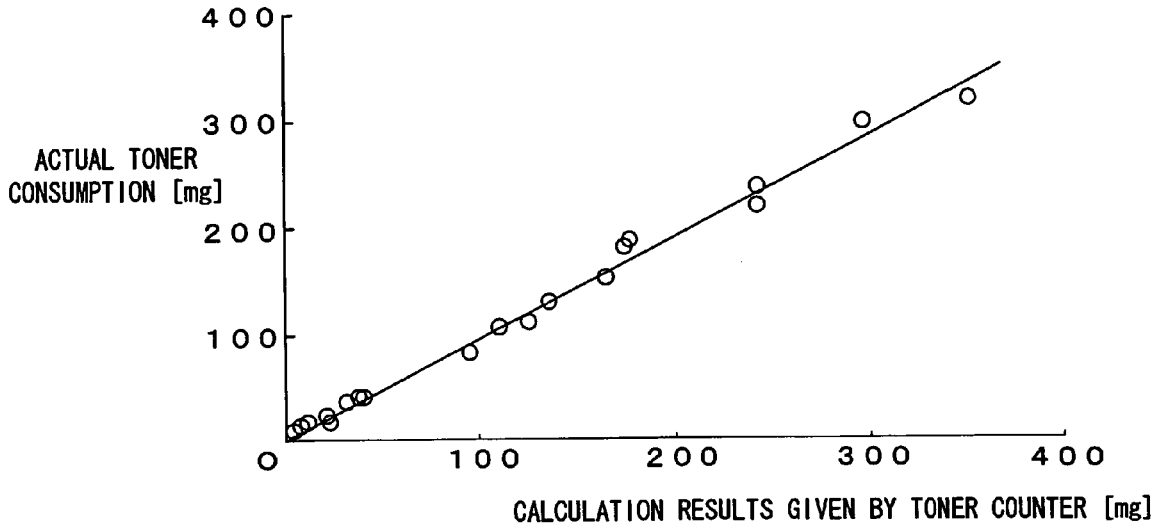
FIG. 11 is a graph showing the calculation results of toner consumption according to the first embodiment.

FIG. 11 is a graph showing the calculation results of toner consumption according to the first embodiment. When various types of images such as character images and graphic images are formed, the calculation method of toner consumption according to this embodiment calculates the toner consumption for each of the sizes of the toner dot portions, by selectively using the toner adhesion rate according to the size of the toner dot portion. Therefore, the calculation method has achieved a favorable agreement (correlation coefficient $R^2$=0.9924) between the toner consumption calculated by the toner counter 220 and the measured toner consumption, as shown in FIG. 11. The results demonstrate that the calculation method of toner consumption according to the invention provides the high-accuracy determination of the toner consumption.

The toner consumptions thus determined may be stored in the RAM 107 of the engine controller 10 as classified by toner color, and may also be stored in the individual memories 94 and such of the developers 4K and such, when required. This permits the toner consumptions thus determined to be used for management of residual quantity of toner in each developer or the like. When any of the developers is running out of the toner, the display section 12 displays a message prompting a user to replace the developer of interest with a new one. In this case, it is possible to figure out an accurate residual quantity of toner in each of the developers because the toner consumption is determined with high accuracies. This saves the user the trouble that the developer becomes disabled before the toner therein is used up, or that the developer runs out of toner before a new developer for replacement is prepared.

In the light of the finding that the toner adhesion rate varies depending upon the size of the toner dot portion to be formed, as described above, the toner counter of the embodiment calculates the toner consumption based on the individual sizes of the toner dot portions to be formed and the toner adhesion characteristic previously and quantitatively determined for each size of the toner dot portion. More specifically, the sizes of the toner dot portions are classified into five groups, whereas in addition to the standard toner adhesion rate K0, the respective toner adhesion rates for the individual groups are defined by defining the correction coefficients K1 through K5 for the individual groups. The lengths of the toner dot portions so classified are integrated on a per-group basis. The integration value of each group is multiplied by its corresponding correction coefficient. The multiplication products of these groups are summed up. The resultant sum is multiplied by the toner adhesion rate K0 so as to determine the amount of toner consumed for forming all the toner dot portions.

Such an approach to determine the toner consumption allows the variations of the toner adhesion characteristic to be reflected on the calculation, the characteristic represented by the toner adhesion rate varying depending upon the size of the toner dot portion. Therefore, the calculation method provides the high-accuracy determination of the toner consumption. Furthermore, the toner consumption in the overall apparatus can be determined by adding the offset value which is the amount of consumed toner other than that used for visualizing the toner dot portions.

As described above, the engine EG of this embodiment functions as the "image forming unit" of the invention. The exposure unit 6, the photosensitive member 22 and the developing roller 44, which are provided at the engine EG, function as an "exposure unit", a "latent image carrier" and a "toner carrier" of the invention, respectively. The toner counter 300 functions as the "toner counter" of the invention as well as the "toner-consumption calculator" of the invention. The main controller 11 functions as a "signal processor" of the invention.

2-3. Second Embodiment

If all the toner dot portions to be visualized during a time period to be subjected to the calculation of toner consumption (at each time interval or at each execution of a job, for example) are those which have substantially the constant toner adhesion rate K0 (equivalent to toner dot portions having lengths of about 6 U or more as illustrated in FIG. 7), the total amount of toner consumed for visualizing all those toner dot portions can be determined by multiplying the total length of these toner dot portions by the standard toner adhesion rate K0. However, in a case where the toner dot portions to be visualized during the calculation period include a toner dot portion having a different size (say, a size 2 U) from that of the toner dot portions having the standard toner rate K0, such a calculation method results in an error. Such an error is increased with increase in the number of toner dot portions of different sizes, which are visualized during the calculation period.

To put it another way, in the calculation of toner consumption using the total length of the toner dot portions and the standard toner adhesion rate K0, the error resulting from the inclusion of the toner dot portion of a different size from that of the dot portions having the standard toner adhesion rate K0 may be reduced by performing a proper correction according to the number of such toner dot portions.

With this in view, this embodiment takes the following steps in the calculation of the amount of toner consumed in a predetermined calculation period, thereby increasing the calculation accuracies:

(1) integrate the values of the tone data (multivalued data) outputted from the half-toning section 116 on an as-needed basis;

(2) multiply the resultant integration value by a coefficient equivalent to the standard toner adhesion rate thereby obtaining a rough estimation of the amount of toner consumed for forming the toner dot portions;

(3) correct the rough estimation based on the toner adhesion characteristic shown in FIG. 7, thereby determining a more accurate toner consumption;

(4) add the offset value equivalent to the amount of toner consumed for the other reasons to the amount of toner thus determined (the amount of toner consumed for forming the toner dot portions), thereby determining an amount of toner consumed by the overall apparatus.

This calculation method is described in more details. In the step (1), the values of the tone data as the information indicating the individual lengths of the toner dot portions formed during the calculation period are integrated, thereby to determine the total length of the toner dot portions formed during this period. The resultant integration value is multiplied by the coefficient equivalent to the toner adhesion rate K0 per unit length, thereby to obtain the rough estimation of the toner consumed for forming the all toner dot portions (step (2)). In this manner, the toner consumption is roughly estimated by a simple calculation process using the values of the signals generated by the signal processing for the image forming operation. This negates the need for providing a special arrangement such as a sensor for detecting the amount of consumed toner. That is, the rough estimation of toner consumption may be obtained by the apparatus of a relatively simple arrangement, which may perform the simple processing.

The rough estimation may possibly contain an error resulting from the inclusion of a toner dot portion having a different size and thence a different toner adhesion rate. Therefore, the step (3) performs the correction for reducing the error. The correction quantity is defined according to the number of toner dot portions to be formed during the period of interest, the toner dot portions having significantly different toner adhesion rates from the standard toner adhesion rate K0. Specifically, the number of 2 U-size toner dot portions to be formed is counted previously, which have the largest difference of toner adhesion rate from the standard toner adhesion rate K0. Then, an additional value for correction is calculated by multiplying the resultant count by the predetermined correction coefficient and then is added to the above rough estimation. The additional value for correction increases as the number of 2 U-size toner dot portions to be formed is increased. The increase of the error is suppressed by performing such a correction so that the toner consumption may be calculated with high accuracies.

This embodiment focuses attention on the 2 U-size toner dot portion having the highest toner adhesion rate so as to affect the accuracy of the toner consumption calculation most significantly. The embodiment is designed to define the correction quantity for the rough estimation of the toner consumption according to the number of such toner dot portions formed. As a matter of fact, the calculation accuracy is also affected by the existence of toner dot portions of the other different sizes. The toner dot portions constituting an image have a substantially regular size distribution, so long as the image is not a specific one. Therefore, the toner consumption can be calculated with adequate accuracies by counting the number of toner dot portions of a particular size, as a typical representative, followed by performing the correction based on the counted value. This is proved by test results to be described hereinlater. It is noted however that the correction coefficient used for the multiplication of the counted value is not always in a consistent correspondence with the toner adhesion rate related to the size.

The correction coefficient used for the multiplication of the counted value may be determined empirically. Specifically, toner images of different types are previously formed and measurement is taken on the amount of toner consumed for forming each of the toner images. The above correction coefficient may be defined in a manner to minimize the difference between the calculation value and the measured value. In this case, the value of the correction coefficient naturally varies depending upon the way to define the size of a toner dot portion to be counted.

The way to define the correction quantity is not, limited to the above. Instead of exclusively counting the number of 2 U-size toner dot portions, for example, toner dot portions which have sizes in a predetermined range (from 2 U to 6 U, for example) and are to be formed may be counted. Then the correction quantity may be decided based on the counted value. In an alternative approach, a plurality of particular sizes (or particular size ranges) may be specified previously and the number of toner dot portions corresponding to each of the particular sizes are counted. Then, the correction quantity is decided based on the counted values. For instance, the respective numbers of 2 U-size toner dot portions and 3 U-size toner dot portions are counted. The resultant counts may be weighted with predetermined weighting coefficients, respectively and summed up to give the correction quantity. Otherwise, the correction quantity may be determined by way of calculation using the resultant counts or by referring the resultant counts to a look-up table. The above weighting coefficient may be decided based on the toner adhesion rate for each size. It is noted in this case that in a case where the correction is made based on the number of toner dot portions having a lower toner adhesion rate than the constant value K0, the correction quantity corresponding to the counted value must be so defined as to take a negative value. The reason is as follows. The aforesaid rough estimation obtained by applying a uniform toner adhesion rate to the toner dot portions having such a low toner adhesion rate tends to be greater than the actual toner consumption. Therefore, some value need be subtracted from the above rough estimation in order to reduce the error.

In this manner, the amount of toner consumed for forming the toner dot portions constituting the toner image may be determined. In addition to the toner so consumed, there exists toner consumed in a manner not to contribute to the formation of the toner image. Hence, the high-accuracy determination of the amount of toner consumed in the overall apparatus dictates the need to count in the amount of toner consumed in this manner. Therefore, the step (4) adds the offset value equivalent to the amount of such toner to the toner consumption previously determined. Thus is obtained the amount of toner consumed in the overall apparatus.

Thus, the toner consumption TC in the overall apparatus in the period of interest may be expressed by the following equation:

$$TC=K11\cdot C11+M\cdot C12+Coff \quad \text{(Equation 2)},$$

where the character C11 represents the integration value of the tone data on all the toner dot portions formed during the period of interest. The integration value is equivalent to the total length of all the toner dot portions. The character K11 represents the coefficient defined in correspondence to the standard toner adhesion rate K0 shown in FIG. 6. The coefficient has a value and a dimension which are used for converting the above integration value to toner quantity on assumption that the toner adhesion rate is constant. The right-hand first term, which is the product of these values, represents the aforesaid "rough estimation of toner consumption".

On the other hand, the right-hand second term represents the "additional value for correction" which is given by multiplying the count C12 of 2 U-size toner dot portions formed during the period of interest by an empirically determined coefficient M. By adding this term, the above rough estimation is so corrected as to be decreased in the error resulting from the inclusion of a toner dot portion of a different toner adhesion rate in the toner dot portions formed.

The right-hand third term represents the offset value equivalent to the amount of toner consumed in the manner not to contribute to the formation of the toner image. The amount of toner so consumed is correlated with the length of operation time of the apparatus, the number of formed images, the operating conditions of the apparatus and the like. Therefore, the toner consumption during the period of interest is estimated based on these information items managed by the engine controller 10, and the resultant estimation is used as the offset value Coff.

Figure 12:
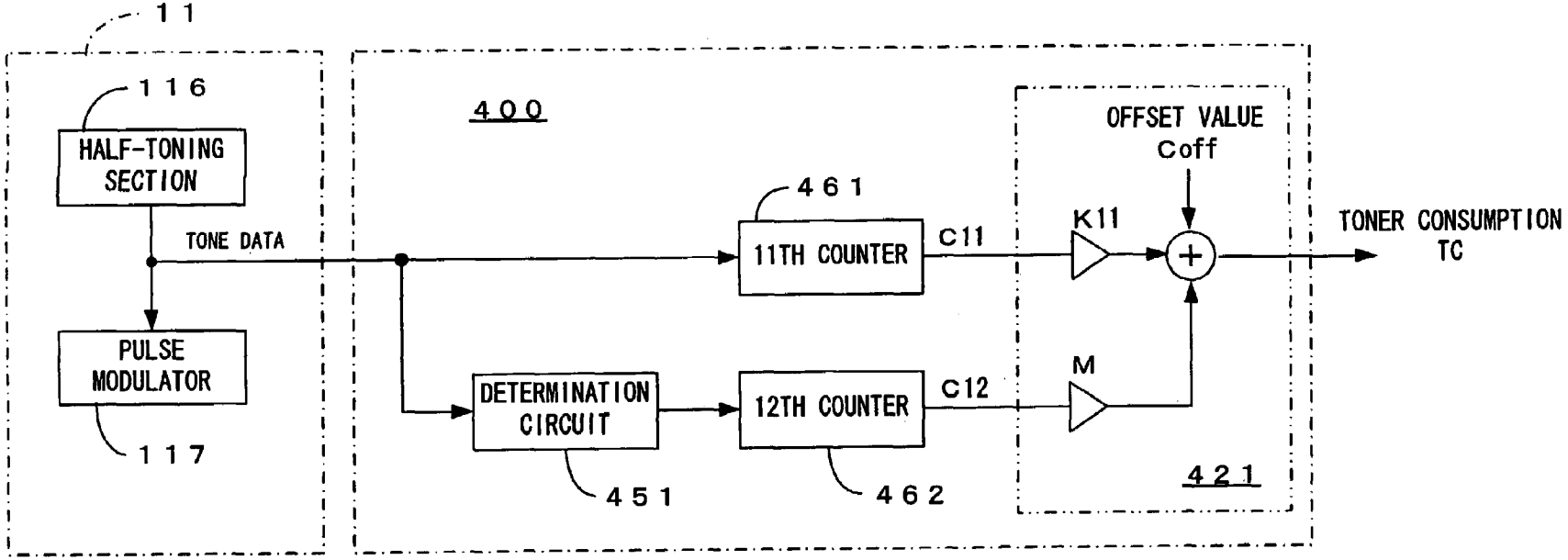
FIG. 12 is a signal flow chart showing an arrangement of the toner counter according to the second embodiment.

FIG. 12 is a signal flow chart showing an arrangement of the toner counter according to the second embodiment. The tone data from the half-toning section 116 of the main controller 11 (FIG. 3) are inputted to an eleventh counter 461. The tone data comprise an 8-bit word (or representing 256 tone levels from 0 to 255). A tone level per word is integrated by the eleventh counter 461. When tone data consisting of three words individually representing tone levels of 255 (100%), 127 (50%) and 0 are inputted, for example, the eleventh counter 461 retains a value 382 or the sum of these words as the integration value. Incidentally, a dot represented by one tone-data word representing a tone level of 255 (the maximum level) is equivalent to the aforesaid "unit dot". That is, the aforementioned length 1 U of the unit dot is equivalent to 1 tone-data word. Therefore, the aforesaid integration value 382, for example, is equivalent to the length of 1.5 U.

The tone data are also inputted to a determination circuit 451 for determining the size of a toner dot portion to be formed. The determination circuit 451 outputs a signal "1" when a toner dot portion represented by an input tone data piece has a length of 2 U, and outputs a signal "0" when the length of the toner dot portion is other than 2 U. Whether the length of the toner dot portion is 2 U or not is determined based on the following criterion. As mentioned supra, one tone-data word representing the tone level 255 is equivalent to one unit dot. When two consecutive tone-data words, each of which represents the value "255", are inputted, a toner dot portion to be formed accounts for two unit dots or has a length of 2 U. Otherwise, the toner dot portion has the other length. In a case where the size of a toner dot portion to be counted is defined to be other than 2 U, as well, the determination may be made by properly changing this judgment criterion. In a case where toner dot portions of different sizes are discretely counted, a required number of determination circuits and counters (described hereinlater) may be added.

The signal outputted from the determination circuit 451 is inputted to a twelfth counter 462, which integrates the output signal from the determination circuit 451. Thus, the twelfth counter 462 counts the number of the outputs "1" from the determination circuit 451 or the number of 2 U-size toner dot portions to be formed during the period of interest and retains the counted value.

When receiving a control command from the CPU 101 in a predetermined timing, the command indicative of the end of the period of interest, the eleventh and twelfth counters 461 and 462 output to an operation section 421 the integration value C11 of the tone data in the period of interest and the number C12 of 2 U-size toner dot portions to be formed, respectively. The integration value and the number of 2 U-size toner dot portions are retained by the respective counters.

The operation section 421 multiplies the received values C11 and C12 by the respective coefficients K11 and M and then, sums up these products and the offset value Coff. The operation section 421 sends back the resultant sum, as the toner consumption TC, to the CPU 101.

Figure 13:
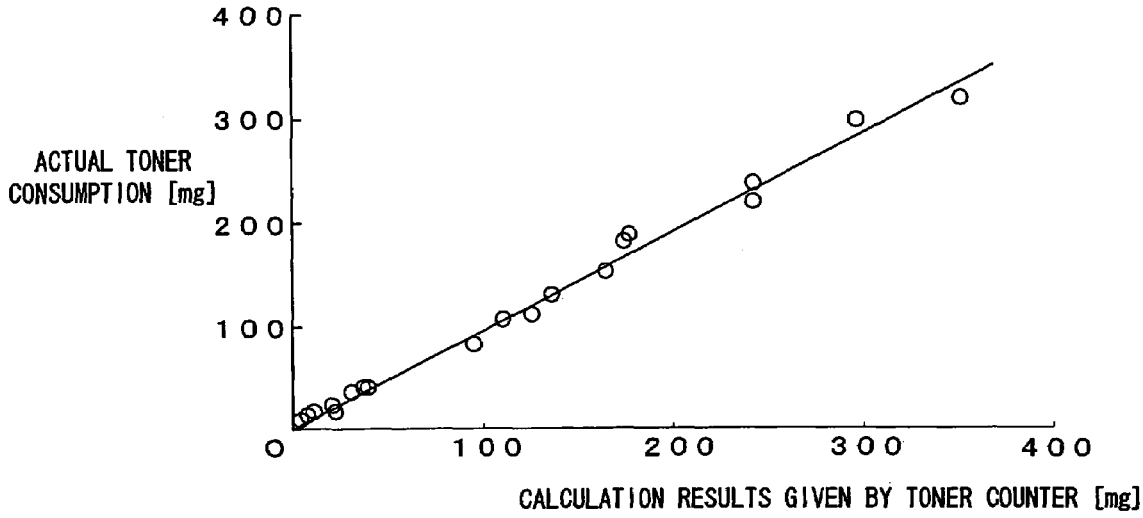
FIG. 13 is a graph showing the calculation results of toner consumption according to the second embodiment.

FIG. 13 is a graph showing the calculation results of toner consumption according to the second embodiment. The coefficients K11 and M were properly defined based on the previous test results. The calculated toner consumptions when the apparatus formed various types of images such as character images and graphic images were compared with the measured values. The calculation method of toner consumption according to the embodiment performs the correction based on the number of formed toner dot portions having the high toner adhesion rate. As shown in FIG. 13, therefore, the method achieved a favorable agreement (correlation coefficient $R^2$=0.9924) between the values calculated by a toner counter 400 and the measured toner consumptions. The results demonstrate that the calculation method of toner consumption according to the invention provides the high-accuracy determination of the toner consumption.

As described above, the embodiment integrates the value of the signal indicative of the size of the toner dot portion to be formed during the predetermined time period (the value of the tone data outputted from the half-toning section 116 to the pulse modulator 117). Then, the rough estimation of the toner consumption is determined by multiplying the integration value by the coefficient equivalent to the standard toner adhesion rate. This approach permits the relatively simple apparatus and processing to figure out the toner consumption roughly.

However, the above rough estimation may possibly contain the error resulting from the inclusion of a toner dot portion having a different size. The error increases with increase in the number of toner dot portions having the toner adhesion rates significantly deviated from the standard value. Therefore, the embodiment suppresses the increase of the error by performing the correction according to the number of such toner dot portions formed, thereby achieving the higher accuracies of the toner consumption calculation. More specifically, the number of 2 U-size toner dot portions formed is counted, which have the highest toner adhesion rate (having the greatest deviation from the standard toner adhesion rate). The counted value is multiplied by the predetermined coefficient to give a value as the additional value for correction, which is added to the above rough estimation. In this manner, the occurrence of the error is prevented to ensure the high-accuracy determination of toner consumption.

The toner consumption calculated in this manner indicates the amount of toner consumed for forming the toner dot portions constituting the toner image. Considering that some toner, in addition to such a toner, is consumed in a manner not to contribute to the formation of the toner image, this embodiment determines the offset value corresponding to the amount of toner consumed in this manner according to the use conditions of the apparatus. Then, the embodiment adds the offset value to the above toner consumption. Therefore, the amount of toner consumed in the overall apparatus during the period of interest can be determined with high accuracies.

In this embodiment, as described above, the engine EG functions as the "image forming unit" of the invention. The photosensitive member 22 and the developing roller 44 provided at the engine EG function as the "latent image carrier" and the "toner carrier" of the invention, respectively. The toner counter 400 functions as the "toner counter" of the invention as well as the "toner-consumption calculator" of the invention. The main controller 11 functions as the "signal processor" of the invention.

2-4. Modifications of First and Second Embodiments

The invention is not limited to the foregoing embodiments and various changes and modifications than the above may be made thereto unless such changes and modifications depart from the scope of the invention. For instance, the toner counter of the first embodiment calculates the toner consumption using the video signal outputted from the pulse modulator 117 of the main controller 11. However, it is also possible to determine the toner consumption by using the multivalued signal indicative of the tone data or the like, which are expressed in numerical values and inputted to the pulse modulator 117. Conversely, the apparatus of the second embodiment may be adapted to calculate the toner consumption based on the video signal. Any other data than these may also be used in the calculation of the toner consumption so long as such data contain information indicative of the size of a toner dot portion to be formed.

The image forming apparatuses of the foregoing embodiments are of a so-called "non-contact development system" wherein the photosensitive member 22 and the developing roller 44 are disposed in face-to-face relation via the gap therebetween. The apparatuses of the non-contact development system are prone to inconsistent toner densities due to the edge effect. The conventional calculation method of toner consumption, which gives little consideration to this drawback, encounters a problem that the error between the calculated toner consumption and the actual toner consumption tends to increase. While the calculation method of toner consumption according to the invention affords a particularly notable effect to such apparatuses, the inventive method may also be applied to an apparatus of a "contact development system" thereby increasing the accuracy of the toner consumption calculation, the contact development system wherein the photosensitive member 22 and the developing roller are in contact with each other.

The aforementioned classification of the sizes of the toner dot portions is a mere illustrative example and the invention is not limited to this. Whatever classification may be specified, it is possible to reduce the amount of information to be stored as well as to ensure the adequate calculation accuracies by taking the approach suggested by the embodiments wherein the sizes are finely classified in a region where the toner adhesion rate per size of toner dot portion varies relatively greatly, but are roughly classified in a region where the toner adhesion percentage varies less.

Furthermore, the embodiments quantify the sizes of the toner dot portions based on the size of the unit dot. Hence, the maximum toner adhesion rate is marked in proximity of a dot length of 2 U equivalent to two unit dots. Based on this, the sizes of toner dot portions classified into each of the groups are defined. However, the size of the toner dot portion, in terms of unit dot, that marks the maximum toner adhesion rate varies depending upon the arrangement or specifications of the apparatus. As a matter of course, it is necessary to modify the classification scheme properly according to the specifications of the apparatus.

While the foregoing embodiments take the steps of integrating the lengths of the toner dot portions in each group, and multiplying the integration value by the correction coefficient, the same results may naturally be obtained if the order of the calculation steps is changed. That is, the same result is given by multiplying the respective lengths of the toner dot portions by the correction coefficient, followed by integrating the individual products.

According to the foregoing embodiments, the toner adhesion rate for each group is determined based on the standard toner adhesion rate K0 and the correction coefficient K1 or such for each group. Then, the toner adhesion rates thus determined are multiplied by the count values given by the counters, respectively, so as to give the toner consumption. In an alternative approach, a coefficient directly expressing the toner adhesion rate for each group may be determined and multiplied by the count value.

In order to permit the apparatus of the first embodiment to achieve even higher calculation accuracies, the number of the aforesaid groups may be increased or the following approach may be taken. The toner adhesion characteristic is approximated by way of a polygonal line or functional curve. The toner consumption may be determined based on the toner adhesion characteristic so expressed and the size of the toner dot portion to be formed. In the case of the toner adhesion characteristic expressed by way of the polygonal line or functional curve, however, it is impossible to adopt the calculation method of the embodiment wherein the sizes of the toner dot portions are previously integrated so as to be collectively multiplied by the toner adhesion rate. Instead, the toner consumption on each toner dot portion must be determined by multiplying the size thereof by the toner adhesion rate and then, the toner consumptions thus obtained must be integrated.

Although the toner adhesion characteristic varies depending upon the arrangement of the apparatus, apparatuses having the same arrangement exhibit substantially the same characteristic. Accordingly, the apparatuses of the same arrangement do not always require the determination of the toner adhesion characteristic on an apparatus-by-apparatus basis. A typical toner adhesion characteristic may be obtained from one or more than one apparatuses and then, be applied to another apparatus for the determination of the toner consumption.

3-1. Basic Principles of Third through Fifth Embodiments

The present inventors conducted the following test. Images of various patterns were formed and measurement was taken on the amount of toner consumed for forming each image. The patterns were constituted by a toner dot portion of the same size but varied in the distance between respective pairs of adjoining toner dot portions. The test results revealed a phenomenon that the toner consumptions on the individual toner dot portions are varied in a complicated manner according to the variations of the distance between the toner dot portions. While a detailed description will hereinlater be made on the mode of variations of the toner consumption, this phenomenon is thought to result from a fact that a measure of toner is also adhered to a region defined between the adjoining toner dot portions and fundamentally designed not to carry the adherent toner thereon, and that the amount of adherent toner on such a region varies depending upon the distance between the adjoining toner dot portions. The test results also suggested the possibility of accurately determining the toner consumptions on the adjoining toner dot portions if the distance between these toner dot portions is known. For example, it is also possible to determine the toner consumption accurately by counting the number of phantom dots (off-dots) fundamentally designed not to carry the adherent toner thereon (or the length of an off-dot portion), in contrast to the conventional technique wherein the number of toner dots to carry the adherent toner thereon (or the length of a toner dot portion) is counted.

Figure 14A:
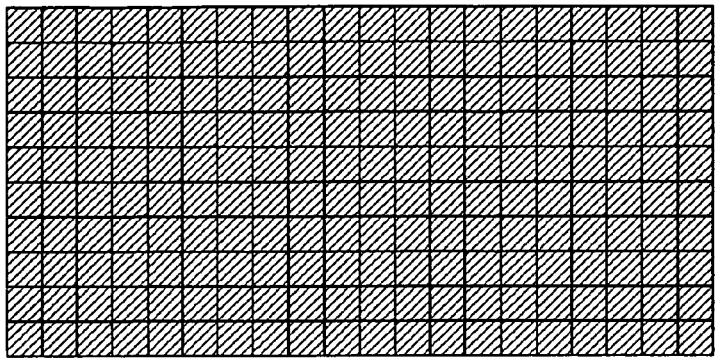
FIG. 14A, FIG. 14B and FIG. 14C are drawings each illustrating an exemplary test pattern used in the test.
Figure 14B:
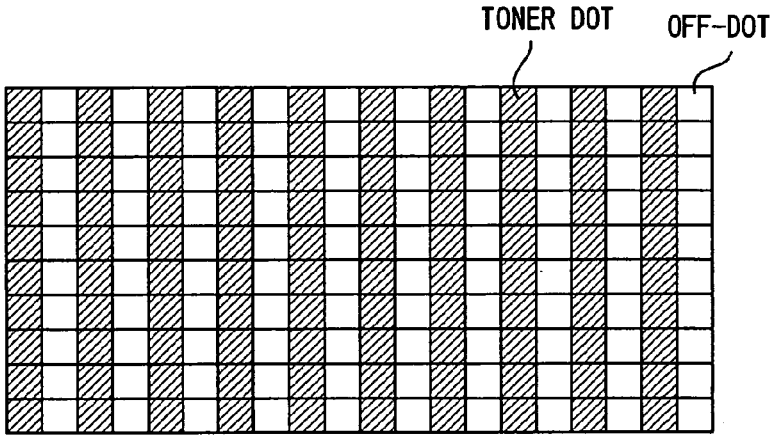
Figure 14C:
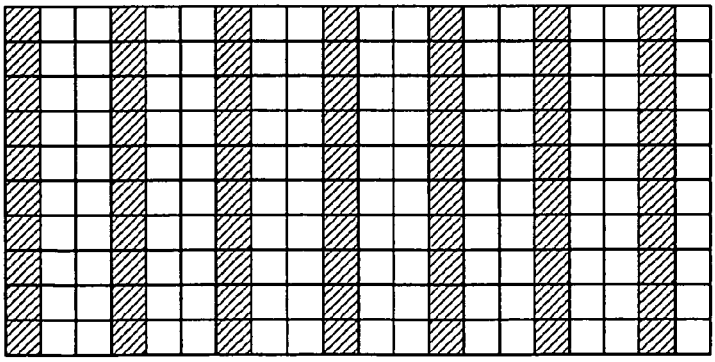

FIG. 14A, FIG. 14B and FIG. 14C each illustrate an exemplary test pattern used in the test. The present inventors operated the image forming apparatus of the aforementioned arrangement to form test-pattern images constituted by the toner dot portions of the same size but varied in the distance between the respective pairs of adjoining toner dot portions. The inventors took measurement on per-dot toner consumption in each image. As shown in FIG. 14A through FIG. 14C, the used test-pattern images were each constituted by a plurality of 1-dot wide lines and varied in the line-to-line distance X. Hereinafter, an image having a line width of 1 dot and a line-to-line distance of X dot will be referred to as a "1-on X-off image". To illustrate, a "1-on 1-off image" is an image wherein 1-dot lines are arranged in parallel and spaced 1 dot apart. A "1-on 2-off image" is an image wherein 1-dot lines are arranged in parallel and spaced 2 dots apart. A pattern image shown in FIG. 14A is a so-called solid image which, in a strict sense, is not called a 1-dot-line image. However, this pattern image is regarded herein as one type of 1-line image having a line-to-line distance X of 0.

In FIG. 14A through FIG. 14C, the "main scan direction" means a scan direction of the light beam L, whereas a "sub-scan direction" means a direction perpendicular to the main scan direction or along which the surface of the photosensitive member 22 moves. The figures illustrate the patterns wherein the line-to-line distance X is an integer or an integral multiple of the dot width. Actually, it is also possible to set the line-to-line distance X to a value other than the integer by controlling the ON-timing of the light beam L. In this test, measurement was also taken on patterns having line-to-line distances of values other than the integer. The figures show only the test patterns consisting of the lines extended along the sub-scan direction, as the typical representatives. This is because the distance between the lines extended along the sub-scan direction can be optionally set by controlling the ON-timing of the light beam L. On the other hand, it is impossible to optionally set a distance between lines extended along the main scan direction because the distance depends upon a moving pitch of the photosensitive member 22 and a scan period of the light beam L. A relation between the line-to-line distance and the toner consumption, as observed in this line image, has the same tendency as that of the relation observed in the image of lines extended in the sub-scan direction.

Figure 15:
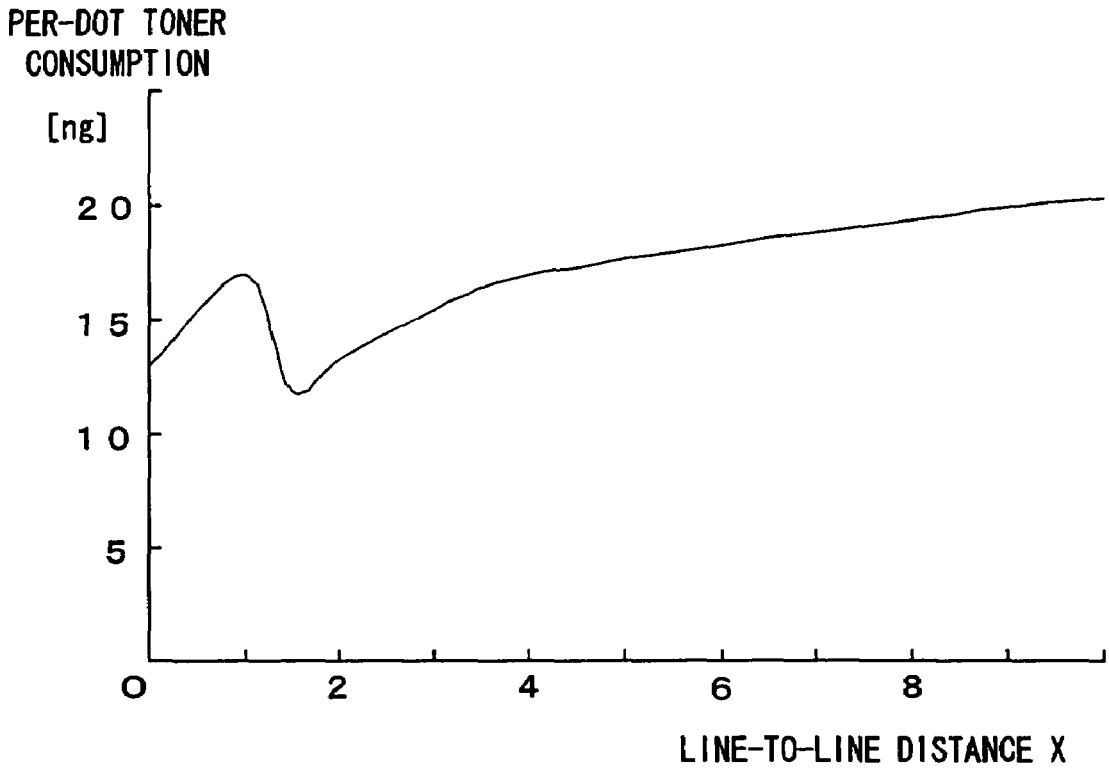
FIG. 15 is a graph showing a relation between the line-to-line distance and the toner consumption.

FIG. 15 is a graph showing a relation between the line-to-line distance and the toner consumption. As shown in FIG. 15, the toner consumption per toner dot varies depending upon the line-to-line distance X, the toner dots forming each line. As the line-to-line distance X is progressively increased from 0, the per-dot toner consumption first increases to some point and then, decreases to the minimum in proximity of X=2. Subsequently, the per-dot toner consumption slowly increases toward a constant value. A model explaining this phenomenon may be exemplified by the followings.

Figure 16A:
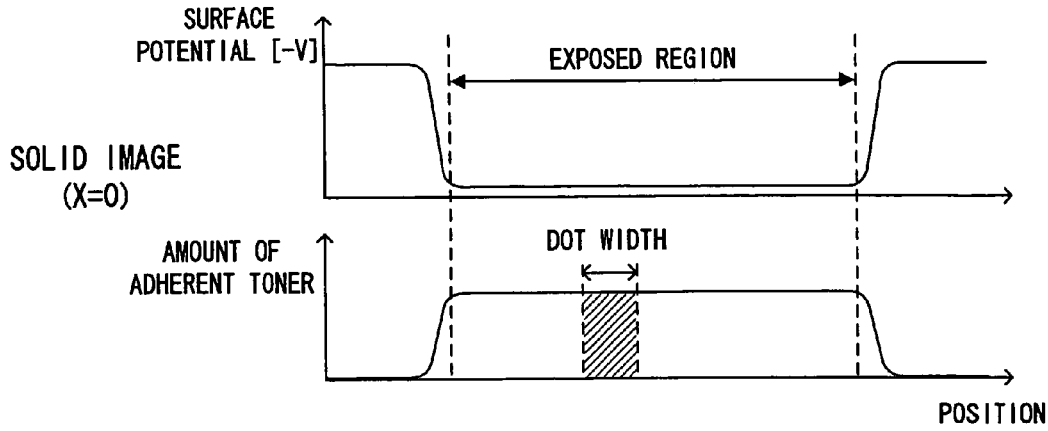
FIG. 16A, FIG. 16B and FIG. 16C are schematic diagrams each showing the surface potential of the photosensitive member and the amount of adherent toner.
Figure 16B:
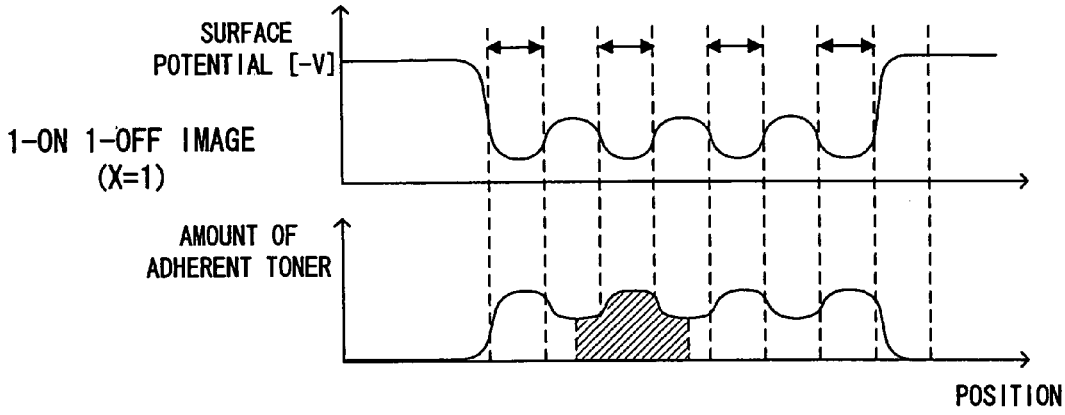
Figure 16C:
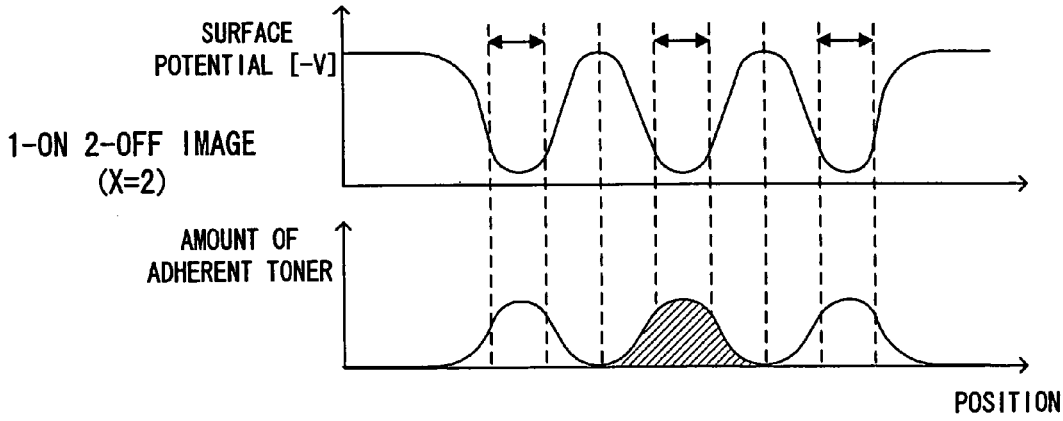

FIG. 16A, FIG. 16B and FIG. 16C are schematic diagrams each showing the surface potential of the photosensitive member and the amount of adherent toner. More specifically, the diagrams show the surface potential profiles of the photosensitive member and the amounts of adherent toner in conjunction with the position on the photosensitive member with respect to the main scan direction, the position plotted on the abscissa. In the case of a solid image (X=0), the surface of the photosensitive member is continuously exposed to the light over a wide region, as shown in FIG. 16A. Therefore, the surface potential at the exposed region of the photosensitive member 22 is adequately and substantially uniformly lowered. That is, the toner adheres to the exposed region substantially uniformly. In this case, a per-dot toner consumption is of a value equivalent to an area of a cross-hatched portion in FIG. 16A.

Next, a 1-on 1-off image (X=1) is contemplated. As shown in FIG. 16B, discontinuous exposed regions are arranged on the photosensitive member. Since the surface potential of the photosensitive member 22 gradually fluctuates in a certain range so that the toner adheres not only to the exposed regions but also to the neighborhood thereof. This results in an increased apparent line width. In the case of a small line-to-line distance, in particular, potential fluctuations at adjoining lines are superimposed on each other and interact with each other to cause a relatively great potential drop at an unexposed region between the lines. Consequently, a substantial amount of toner adheres to the region between the lines. Actually, the surface of the photosensitive member 22 was examined to see how the toner adheres to the surface. It was found that the toner also adheres to a wide portion of the line-to-line region fundamentally designed not to carry the adherent toner thereon. Therefore, a per-dot toner consumption which is equivalent to an area of a cross-hatched portion in FIG. 16B is greater than that of the solid image.

Let us contemplate a case where the line-to-line distance is increased further. FIG. 16C illustrates a 1-on 2-off image (X=2). In this case, as well, the toner adhesion extends to outside areas of the exposed regions because the surface potential of the photosensitive member gradually fluctuates. However, the interaction between the potentials at the adjoining lines is weak because of the great line-to-line distance, so that the toner adhesion to the region between the lines is decreased. Therefore, a per-dot toner consumption which is equivalent to an area of a cross-hatched portion in FIG. 16C is greater than that of the solid image but is smaller than that of the 1-on 1-off image. If the line-to-line distance is increased further, the variation of the toner adhesion associated with the adjoining lines should be little.

Figure 17:
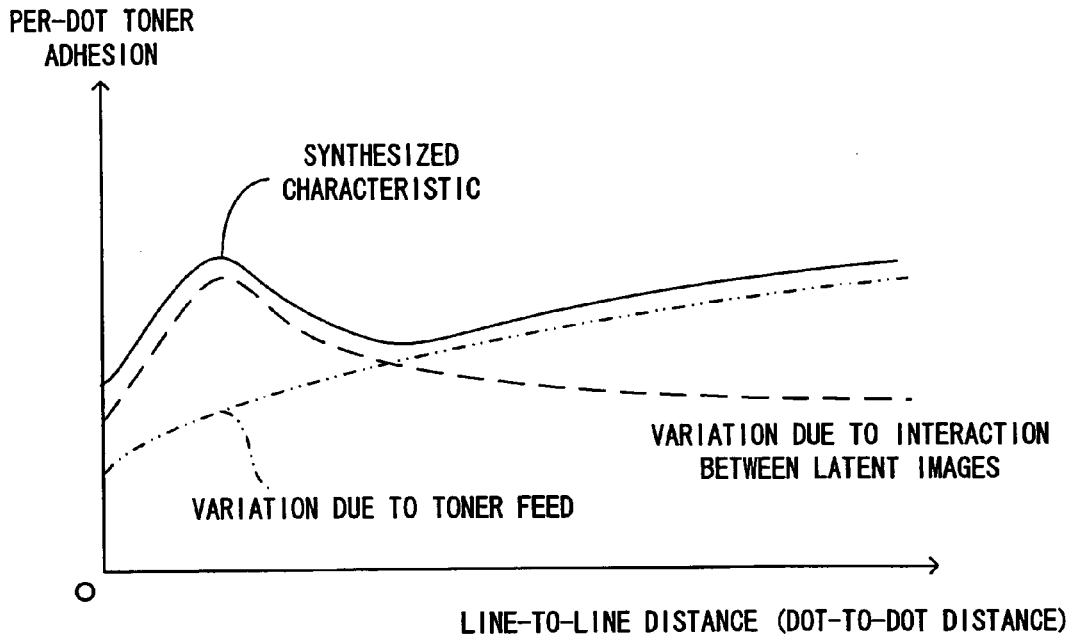
FIG. 17 is a graph showing a relation between the line-to-line distance and the toner adhesion.

FIG. 17 is a graph showing a relation between the line-to-line distance and the toner adhesion. It may be inferred from the above contemplation that the relation between the line-to-line distance and the toner adhesion, as indicated by a broken line in FIG. 17, is such that the toner adhesion first increases to some degree as the line-to-line distance increases but thereafter, the toner adhesion drops to a substantially constant value. However, the inference does not agree with the test results. As mentioned supra, the toner consumption once drops in conjunction with the increase of the line-to-line distance and then, increases again slowly. This is thought to be the result of a constant toner feed from the developing roller 44 to the surface of the photosensitive member 22. That is, with a small line-to-line distance, a region designed to carry the adherent toner thereon accounts for a larger proportion of the surface area of the photosensitive member 22. Conversely, with a great line-to-line distance, the region designed to carry the adherent toner thereon accounts for a smaller proportion. On the other hand, the toner feed is constant regardless of the varied proportions of such a region. Therefore, a per-unit-area toner feed to the region to carry the adherent toner thereon is supposedly decreased as the line-to-line distance decreases. As a result, a per-unit-area toner adhesion to the photosensitive member 22 is supposedly decreased, as well. From the viewpoint of the toner feed, the toner adhesion may increase with increase in the line-to-line distance, as indicated by two-dots and dash lines in FIG. 17.

Figure 18:
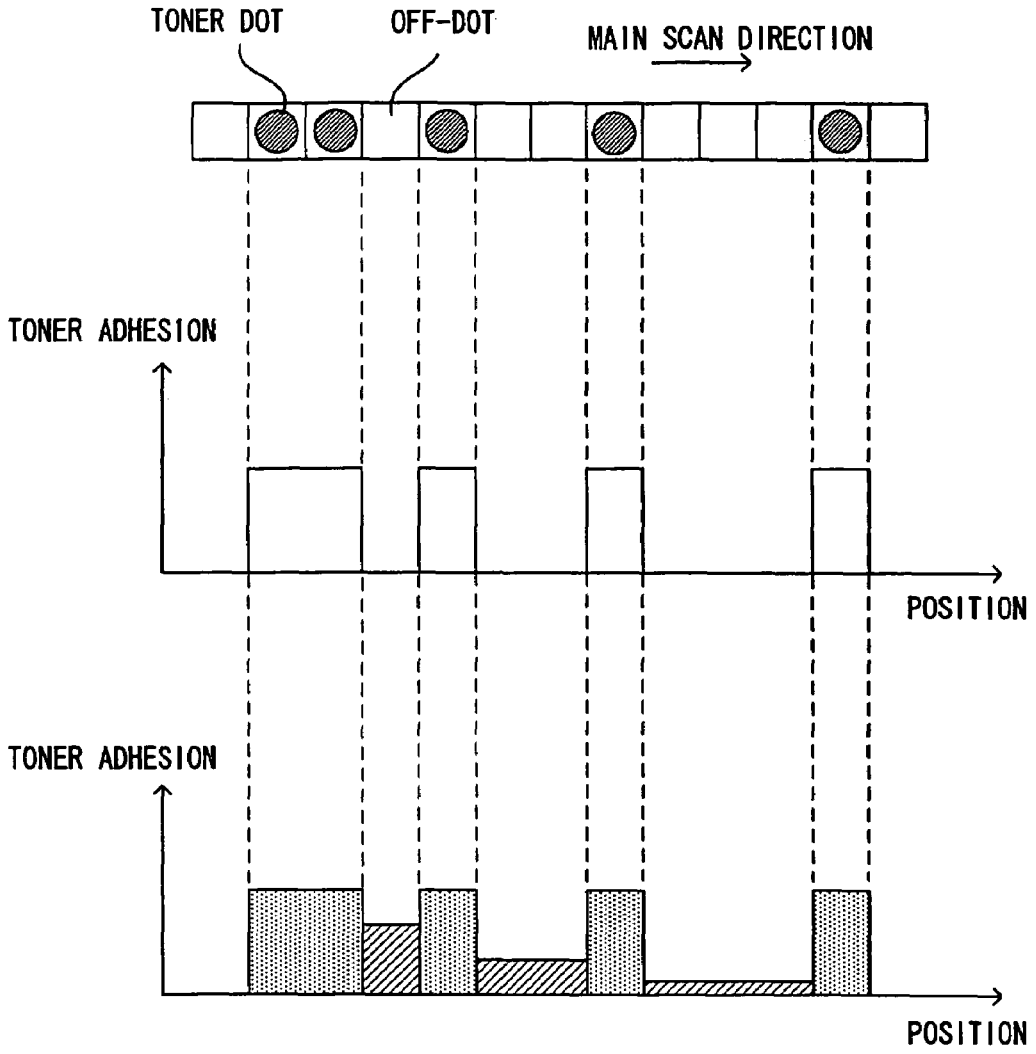
FIG. 18 schematically shows toner adhesions to the toner dot and to the off-dot.

In actual fact, the influences of the aforementioned two phenomena may be combined together to effect the relation indicated by a solid line in FIG. 18, wherein with increase in the line-to-line distance, the toner adhesion first increases to some degree, drops thereafter, and then slowly increases again. Such a characteristic is thought to be particularly apparent in the apparatuses of the non-contact development system wherein the photosensitive member is spaced from the developing roller via the minute gap therebetween. The apparatus of this type allows the toner particles to jump across a space where the photosensitive member is closest to the developing roller. That is, the jumping toner particles are free to move in this space.

In the example of FIG. 15, the per-dot toner consumption is at maximum in proximity of the line-to-line distance X=1 but is at minimum in proximity of X=2. These numerical values depend upon the arrangement of the apparatus such as a spot size of the light beam L, a material and a thickness of the photosensitive member. Hence, these values naturally vary if the apparatus is arranged differently.

Given the same line width, the amount of toner consumed for forming the lines varies according to the line-to-line distance. This tendency is observed not only in the lines in the main scan direction but also in the lines in the sub-scan direction perpendicular thereto or in other lines such as slant lines. To put it more generally, the per-dot toner consumption varies depending upon the distance between a dot of interest and another dot. It is more practical to think that such toner consumption variations result from a phenomenon that the amount of toner adherent to the off-dot portions around the toner dot portion is varied due to the consecutive off-dots, rather than from a phenomenon that the amount of toner adherent to the toner dot portion is varied.

FIG. 18 schematically shows toner adhesions to the toner dot and to the off-dot. Given a dot string shown in an upper part of FIG. 18, it is ideal as shown in an intermediate part of FIG. 18 that a constant amount of toner adheres to the toner dot portion whereas no toner adheres to the off-dot portion at all. If the toner adheres in such an idealistic manner, the toner consumption may be accurately determined by counting the number of toner dots and multiplying the count value by the per-dot toner adhesion. In actual fact, however, the toner also adheres to the off-dot portion as indicated by a cross-hatched portion shown in the lower part of FIG. 18. In addition, the toner adhesion to the off-dot portion varies depending upon the mode of consecutive off-dots. This suggests that the overall toner consumption can be determined with higher accuracies by focusing the attention on the number of off-dots and the mode of consecutive off-dots rather than on the number of toner dots and the mode of consecutive toner dots, as practiced by the conventional technique. As compared with the conventional toner counting technique wherein the toner consumption is calculated from the number of toner dots (or the length of the toner dot portion), a higher calculation accuracy can be achieved by performing correction based on the number of off-dots or the length of the off-dot portion.

The following description is made on three embodiments of a toner counter designed to calculate the toner consumption based on the foregoing knowledge. Similarly to the foregoing embodiments, the toner counters to be described as below may also be implemented using software or hardware. While the following description is made on assumption that the ON/OFF control of the light beam L is provided on a 1-dot basis, the same concept is also applicable to a case where the ON/OFF control is provided based on a unit other than 1 dot.

3-2. Third Embodiment

Figure 19:
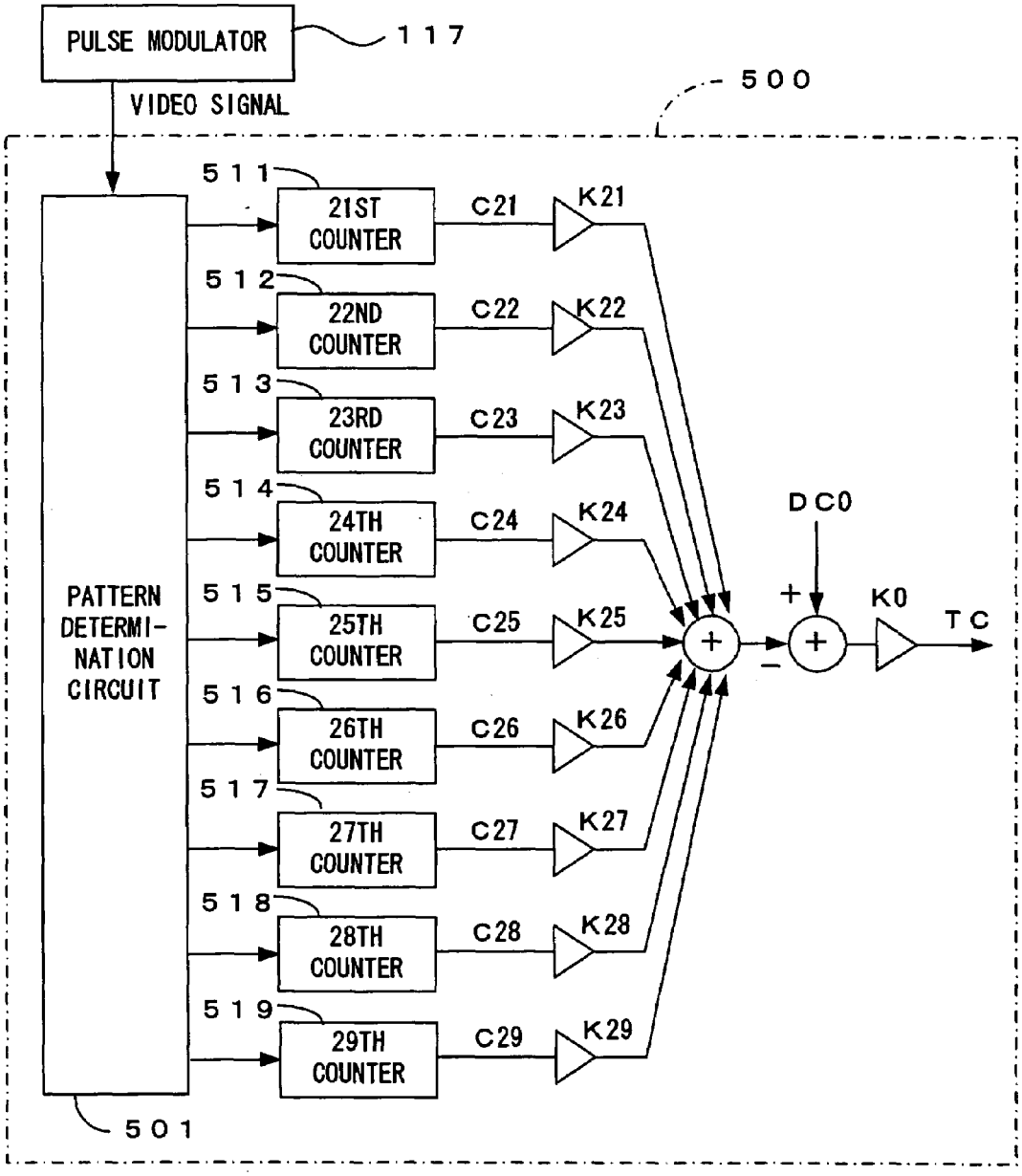
FIG. 19 is a diagram showing a toner counter according to the third embodiment of the invention.
Figure 20:
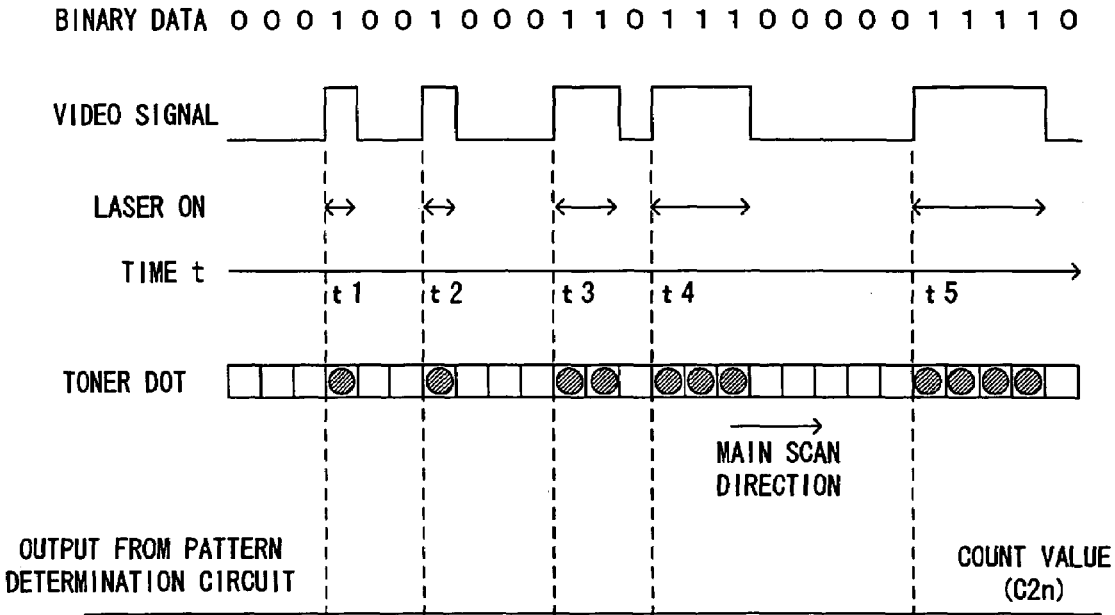
FIG. 20 is a diagram showing operations of the toner counter of the third embodiment.

FIG. 19 is a diagram showing a toner counter according to the third embodiment of the invention. FIG. 20 is a diagram showing operations of the toner counter of the third embodiment. A toner counter 500 of this embodiment is designed to calculate the toner consumption per toner color when one page of image is formed. The toner counter 500 includes a pattern determination circuit 501 which determines a dot array on one scan line along the main scan direction based on the video signal outputted from the pulse modulator 117. The toner counter further includes twenty-first to twenty-ninth counters 511 through 519 for counting a value outputted from the pattern determination circuit 501. More specific operations of the pattern determination circuit 501 and the counters 511 through 519 are described with reference to FIG. 20.

A signal outputted form the pulse modulator 117 is a pulse signal shifted between an H-level and an L-level in correspondence to the ON/OFF of the light beam L. The pulse signal is represented herein by binary data in which the H-level has a value 1 whereas the L-level has a value 0. It is assumed that a video signal outputted from the pulse modulator 117 represents a pattern shown in FIG. 20, for example. When a leading edge of the pulse signal or a 0-to-1 shift of the binary data is detected, the pattern determination circuit 501 determines the length of an L-level period just prior to the leading edge or the number of consecutive 0-signals. The circuit outputs the resultant value to any one of the counters 511 to 519 that corresponds to the value. At time t1 in FIG. 20 when the binary data shifts from 0 to 1, for example, the pattern determination circuit 501 outputs a value 3 to the twenty-third counter 513 because three consecutive 0-values are detected just prior to the shift. Similarly, at respective times t2, t3, t4 and t5 when the binary data shifts from 0 to 1, the pattern determination circuit 501 outputs the respective numbers of consecutive 0-values just prior to the shift, or 2, 3, 1 and 5 to the twenty-second counter 512, the twenty-third counter 513, the twenty-first counter 511 and the twenty-fifth counter 515. In a case where the number of consecutive 0-values is more than 9, the circuit outputs the number of consecutive 0-values to the twenty-ninth counter 519. This operation is repeated in cycles on data on one page of image.

In this manner, each of the counters 511 through 519 integrates each number of consecutive phantom dots (off-dots) to which the toner is not made to adhere by turning off the laser. A value given by summing up all the count values outputted from the counters 511 through 519 is equal to the number of off-dots on one page. The reason for counting the off-dots based on each set of consecutive off-dots is to deal with the toner adhesion to the toner dots adjoining the off-dots, which is varied according to the mode of the consecutive off-dots.

When the dot counting on one page of image is completed, the counters 511 through 519 output their respective count values C21 through C29. These count values C21 through C29 are multiplied by coefficients K21 through K29, respectively, the coefficients previously defined according to the respective modes of the consecutive off-dots. All the products are added up to give the number of off-dots per page, which is properly weighted according to the modes of consecutive off-dots. Then, a per-page toner consumption TC is calculated by subtracting the resultant off-dot value from a previously defined constant DC0 and multiplying the resultant difference by a proportionality constant K0. That is, this embodiment calculates the toner consumption TC using the following equation:

$$TC=K0\cdot\{DC0-(K21\cdot C21+K22\cdot C22+\ldots+K28\cdot C28+K29+C29)\} \quad \text{(Equation 3).}$$

In the above (Equation 3), the constant DC0 represents the total number of dots on one page, or the sum of toner dots and off-dots on one page. The total number of dots may be determined from the size of an image and the resolution of the apparatus. The coefficient K0 represents a value equivalent to a toner adhesion per toner dot in a solid image. The value can be empirically determined in advance. In short, the embodiment calculates the amount of toner consumed for forming the toner dots by subtracting the amount of toner corresponding to the number of off-dots fundamentally designed not to carry the adherent toner thereon from the amount of toner consumed for forming a full page of solid image. In this process, the number of off-dots is not simply counted but each set of consecutive off-dots is counted and weighted with a predetermined value according to the mode of consecutive off-dots. Thereafter, the resultant counts are added up. That is, the amount of toner to be subtracted based on the number of off-dots is determined according to the mode of consecutive off-dots. Thus, the above (Equation 3) provides the high-accuracy determination of the toner consumption on the overall page. The coefficients K21 through K29 may be defined in the following manner, for example.

Figure 21:
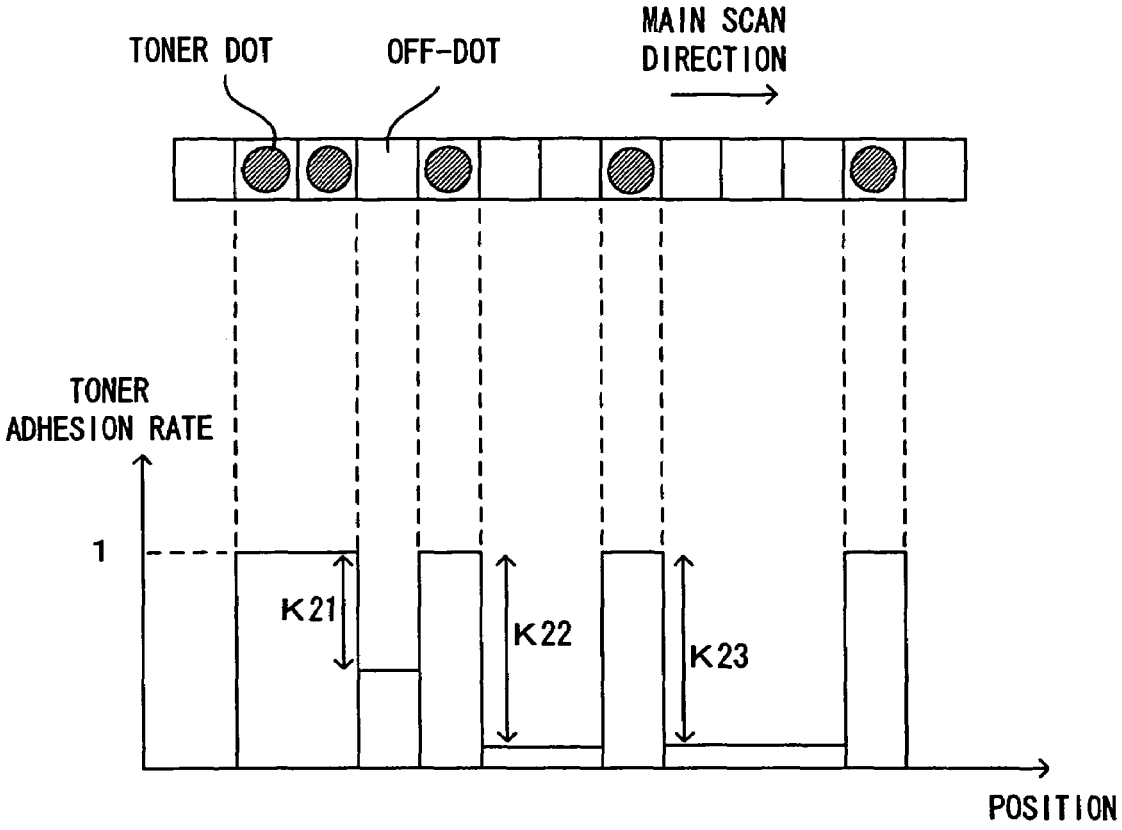
FIG. 21 is a diagram showing how to define the coefficients of the third embodiment.

FIG. 21 is a diagram showing how to define the coefficients of the third embodiment. It is assumed for example that toner adhesion percentages empirically determined (or obtained through a proper simulation) are those (per-dot toner adhesion normalized based on the toner adhesion of solid image defined as 1) shown in FIG. 21. Although the toner is inconsistently adhered to the toner dot portion and the off-dot portion as shown in FIG. 16B and FIG. 16C, it may be assumed from a practical viewpoint that the toner is substantially uniformly distributed. Here, a toner adhesion rate of the toner dot portion is approximately 1. On the other hand, toner adhesion rates of individual off-dot portions are all less than 1, varying depending upon the number of consecutive off-dots. The decreased quantity of the toner adhesion rate of the off-dot portion based on the toner dot portion is represented by a coefficient K2n (n represents the number of consecutive off-dots n=1, 2, . . . ).

Figure 23:
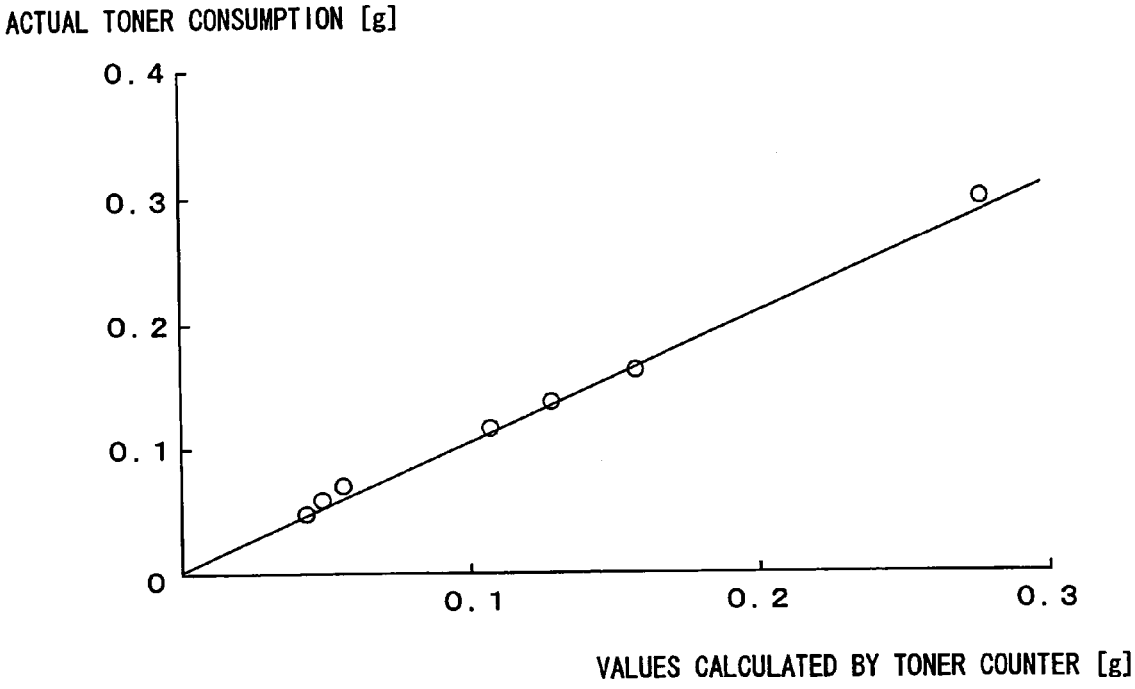
FIG. 23 is a graph showing toner consumptions calculated by the toner counter of the third embodiment.

FIG. 22 is a table showing an example of the coefficients for the toner counter of the third embodiment. FIG. 23 is a graph showing toner consumptions calculated by the toner counter of the third embodiment. In this embodiment, the coefficients were set to individual values shown in FIG. 22 based on the measurements of the characteristic (FIG. 15) of the apparatus of FIG. 1. The values calculated by the toner counter 500 of the embodiment were compared with measured toner consumptions per Japanese Industrial Standards (JIS) A4-size sheet. As shown in FIG. 23, the calculated values were in good agreement with the measured values (correlation coefficient $R^2$=0.9501). It was thus confirmed that the toner counter 500 of the embodiment is capable of determining the toner consumption with high accuracies.

As described above, the toner counter according to the third embodiment of the invention counts the number of off-dots to which the toner is not made to adhere, and determines the toner consumption per page of image based on the counted value. Similarly to the conventional technique wherein the number of toner dots is counted, it is also possible to determine the toner consumption by counting the number of off-dots. Particularly, the toner counter is adapted to count the respective sets of consecutive off-dots, thereby dealing with the varied toner adhesions associated with the different numbers of consecutive off-dots. Thus, the toner counter accomplishes the high-accuracy determination of the toner consumption.

The toner counter of the third embodiment takes the steps of: determining the off-dot count by weighting the number of off-dots according to the length of the off-dot portion; subtracting the off-dot count from the total number of dots on one page; and calculating the per-page toner consumption based on the difference value. The difference value contains the number of inherent toner dots and the number of phantom dots which is given by converting the amount of toner adherent to the off-dot portion. The toner counter of the third embodiment multiplies this difference value by the toner adhesion per toner dot. Hence, the toner counter is adapted to accomplish the high-accuracy determination of the total toner consumption which counts in the amount of toner adherent to the off-dot portion.

3-3. Modifications of Third Embodiment

As mentioned supra, the toner dot actually formed and the off-dot do not always have sizes based on 1-dot unit. In cases, the toner dot or off-dot may also have a size of a fractional figure, such as 0.5 dots or 1.5 dots, depending upon the length of operation time of the laser. In order to deal with such a dot size, the toner counter of the third embodiment may be modified as follows, for example.

FIG. 24 shows an exemplary modification of the toner counter of the third embodiment. In this example, the off-dot portions are classified into plural levels based on the length thereof rather than the number of consecutive off-dots. Specifically, the lengths of the off-dot portions are classified into 6 levels which include: 0-0.5 dots; 0.5-1.5 dots; 1.5-2.5 dots; 2.5-4.5 dots; 4.5-6.5 dots; and 6.5 dots or more. Counters are provided in correspondence to the respective levels, whereas coefficients Ka to Kf are assigned to the respective counters. This arrangement provides an ability to adequately deal with a more general case where the dot size is not based on 1-dot unit. As a matter of course, the classification of the dot size is not limited to the above numerical values and may be changed as required. Furthermore, toner counters according to the fourth and fifth embodiments (described hereinlater) may also be subjected to similar modifications. That is, the classification of the off-dots and the coefficient assignment may be changed properly, whereas the pattern determination circuit may be so modified as to output a value corresponding to a size of the toner dot to any of the counters on the backside stage.

The aforementioned toner counter of the embodiment counts the number of off-dots based on 1-dot unit. Where three consecutive off-dots appear, for example, a value of 3 is outputted to the twenty-third counter 513. In an alternative approach, the whole set of consecutive off-dots may be counted as a single off-dot. In the above case, for example, the three consecutive off-dots may be regarded as a single off-dot so that a value of 1 is outputted to the twenty-third counter 513 corresponding to the length of the off-dots. This approach, however, requires a kind of modification of the coefficients K21 through K29.

3-4. Fourth Embodiment

A toner counter of this embodiment determines the overall toner consumption per page by adding the amount of toner adherent to the off-dot portions (equivalent to the area of the cross-hatched portions in FIG. 18) to the amount of toner adherent to the toner dots adjoining the off-dot portions (equivalent to the area of dotted portions in FIG. 18).

Figure 25:
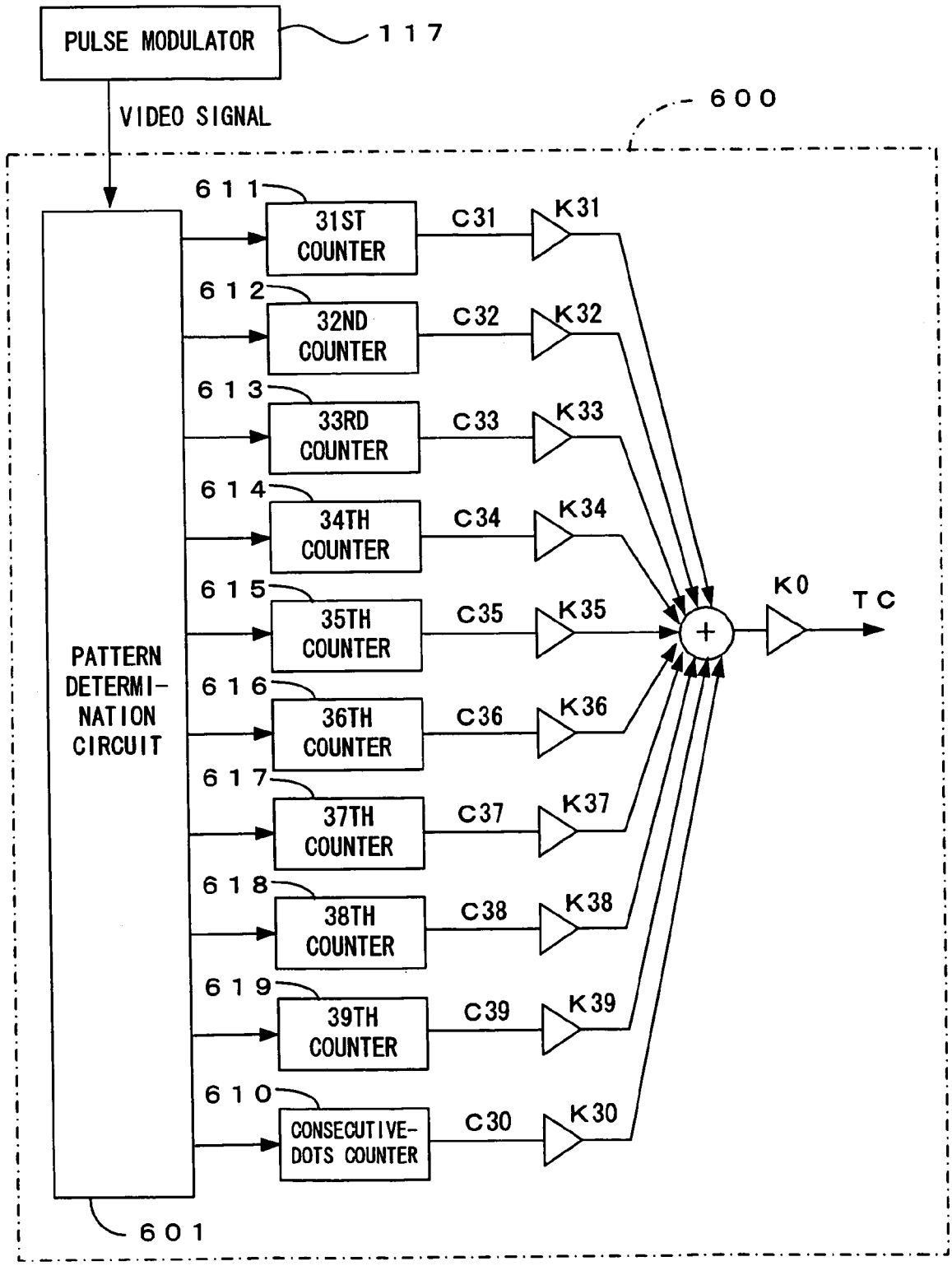
FIG. 25 is a diagram showing the toner counter according to a fourth embodiment of the invention.
Figure 26:
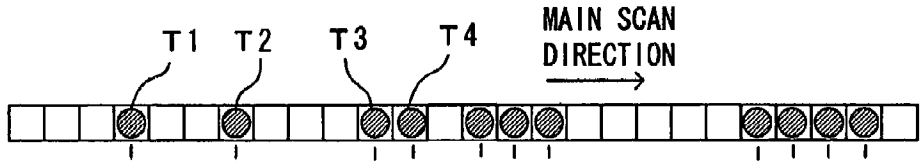
FIG. 26 is a diagram showing operations of the toner counter of the fourth embodiment.

FIG. 25 is a diagram showing the toner counter according to a fourth embodiment of the invention. FIG. 26 is a diagram showing operations of the toner counter of the fourth embodiment. The toner counter 600 includes a pattern determination circuit 601 which determines a dot array on one scan line along the main scan direction based on the video signal outputted from the pulse modulator 117. The toner counter also includes thirty-first to thirty-ninth counters 611 through 619 for counting a value outputted from the pattern determination circuit 601. However, the operations of these components differ from those of the components provided at the toner counter 500 of the third embodiment. The toner counter 600 of this embodiment further includes a consecutive-dots counter 610. Specific operations of these components are described with reference to FIG. 26.

The pattern determination circuit 600 makes determination on the presence of the toner dot based on the video signal. At each appearance of the toner dot, the circuit outputs a value 1 to any of the counters 610 through 619 on the backside stage. It is noted that the counter to receive the output is one that corresponds to the number of off-dots just prior to the toner dot of interest. According to the example of FIG. 26, there exist three off-dots (on the left-hand side in FIG. 26) just prior to the appearance of the leftmost toner dot T1 and hence, the pattern determination circuit 601 outputs the value 1 to the thirty-third counter 613 corresponding to a set of three off-dots. Similarly, at respective points in time that toner dots T2 and T3 appear, the pattern determination circuit 601 outputs the value 1 to the thirty-second counter 612 and to the thirty-third counter 613 corresponding to a set of two off-dots and a set of three off-dots, respectively.

The subsequent toner dot T4 immediately follows the preceding toner dot T3. When such a toner dot T4 appears, the pattern determination circuit 601 outputs the value 1 to the consecutive-dots counter 610. In other words, the pattern determination circuit 601 outputs the value 1 to the counter 610 when the toner dot is preceded by no off-dot. In this manner, the pattern determination circuit 601 outputs the value 1 to any of the counters 610 through 619 according to the number 0-9 of off-dots just prior to the toner dot. The counters 610 through 619, in turn, each integrate the output values.

Then, at each appearance of a new toner dot, the pattern determination circuit 601 determines the number of off-dots just prior to the toner dot, and outputs the value 1 to any one of the counters 610 through 619 that corresponds to the number of off-dots. In a case where more than nine consecutive off-dots appear, the circuit outputs the value 1 to the thirty-ninth counter 619. This operation is repeated in cycles on data on one page of image.

In this manner, the counters 611, 612, 613, 614, 615, 616, 617, 618 and 619 individually count the respective number of toner dots immediately following one, two, three, four, five, six, seven, eight and nine or more off-dots. On the other hand, the consecutive-dots counter 610 counts the number of toner dots immediately following a toner dot or preceded by no off-dot. Accordingly, all the count values given by these counters 610 through 619 are summed up to give the number of all the toner dots formed.

In other words, the counters count the number of off-dot strings each consisting of 0 or more consecutive off-dots. That is, as shown in FIG. 26, the thirty-first counter 611 indicating a count value C31 of '1' suggests that there has appeared one off-dot string consisting of a single off-dot. The thirty-third counter 613 indicating a count value C33 of '2' suggests that there have appeared two off-dot strings each consisting of three consecutive off-dots. The consecutive-dots counter 610 indicating a count value C30 of '6' suggests that there have appeared six off-dot strings each consisting of zero off-dot.

When the counting operation on the data on one page of image is completed, the counters 610 through 619 output their respective count values C30 through C39. The count values C30 through C39 are multiplied by predetermined coefficients K30 through K39, respectively and the respective products are summed up. Then, the resultant sum is multiplied by the coefficient K0 thereby to give the toner consumption TC per page. The embodiment calculates the toner consumption TC using the following equation:

$$TC=K0\cdot(K30\cdot C30+K31\cdot C31+\ldots+K38\cdot C38+K39\cdot C39) \quad \text{(Equation 4)},$$

in which the coefficient K0 is equivalent to the per-dot toner consumption on solid image, just as in the third embodiment. On the other hand, the coefficients K30 through K39 may be defined as follows, for example.

Figure 27A:
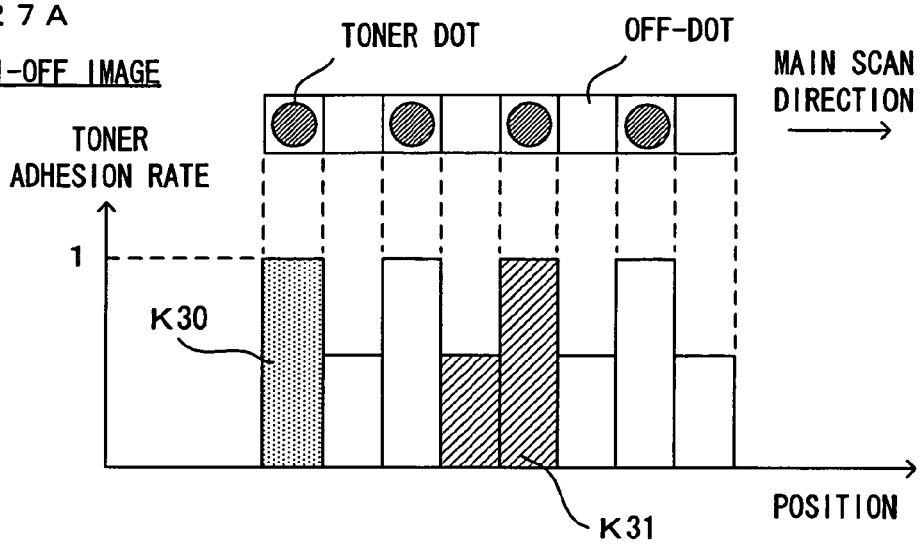
FIG. 27A and FIG. 27B are diagrams each showing how to define the coefficients of the fourth embodiment.
Figure 27B:
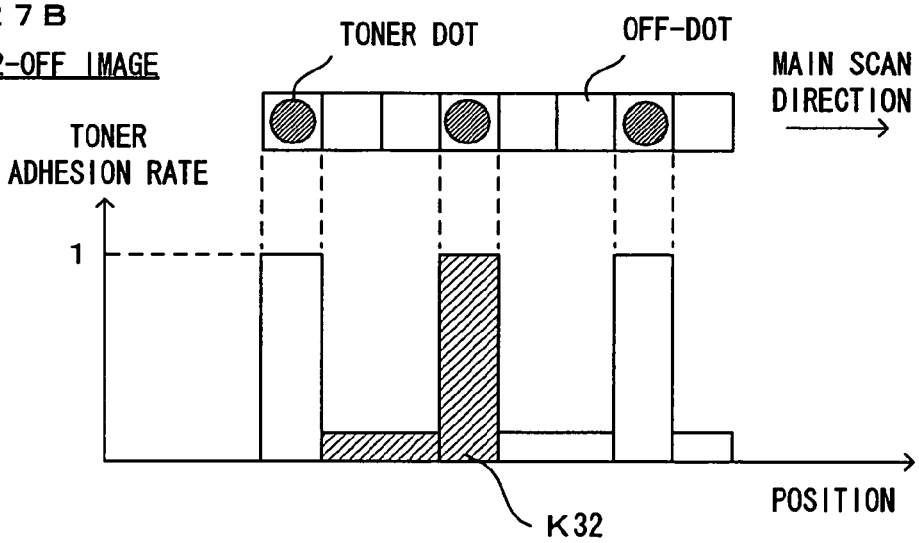

FIG. 27A and FIG. 27B are diagrams each showing how to define the coefficients of the fourth embodiment. It is assumed for example that toner adhesion rates empirically determined for individual sets of consecutive off-dots (or obtained through a proper simulation) are those shown in FIG. 27A and FIG. 27B. In this case, the toner adhesion rate of the toner dot portion (the area of a dotted portion in FIG. 27A) is equivalent to the coefficient K30. Since the toner adhesion rate of the toner dot portion is assumed here to be approximately 1, the value of the coefficient K30 is defined as 1. On the other hand, the coefficient K31 may be defined by the sum of toner adhesion rates of one toner dot and the preceding off-dot portion in a 1-on 1-off image (the area of a cross-hatched portion in FIG. 27A). The coefficient K32 may be defined by the sum of toner adhesion percentages of one toner dot and the preceding off-dot portion in a 1-on 2-off image (the area of a cross-hatched portion in FIG. 27B). The other coefficients K33 through K39 may be defined the same way.

Figure 29:
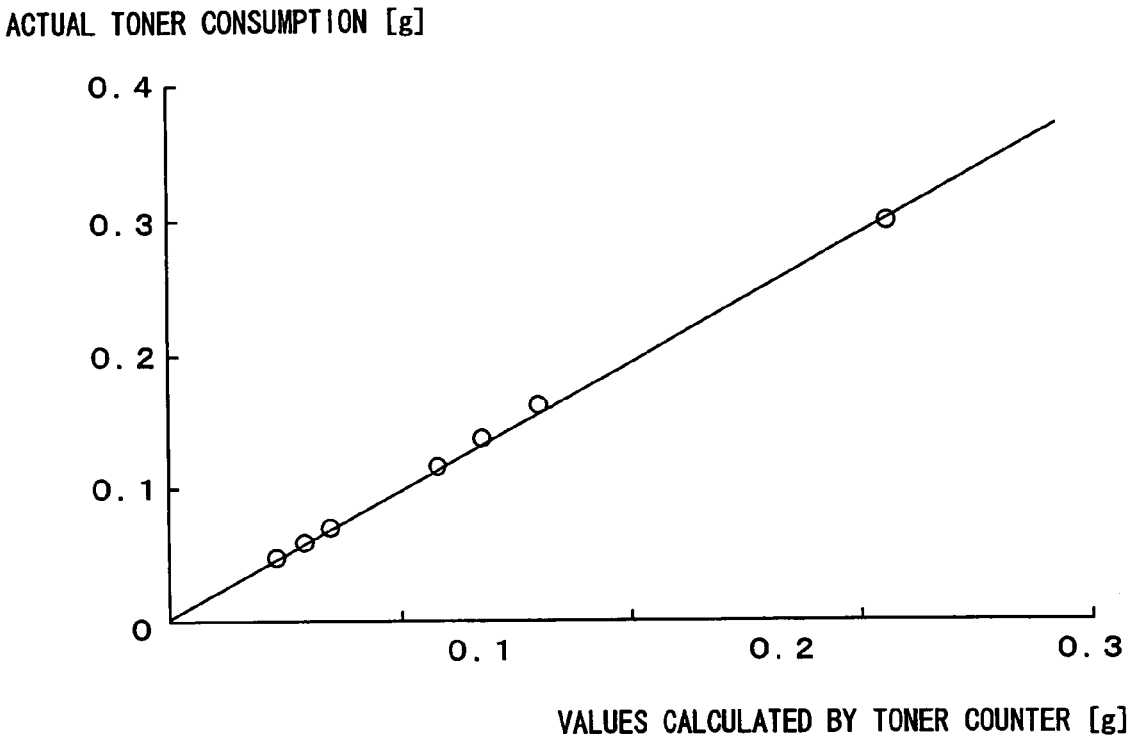
FIG. 29 is a graph showing toner consumptions calculated by the toner counter of the fourth embodiment.

FIG. 28 is a table showing an example of the coefficients for the toner counter of the fourth embodiment. FIG. 29 is a graph showing toner consumptions calculated by the toner counter of the fourth embodiment. In this embodiment, the coefficients were set to individual values shown in FIG. 28 based on the measurements of the characteristic (FIG. 15) of the apparatus of FIG. 1. The calculation results given by the toner counter 600 of the embodiment were compared with measured toner consumptions (per JIS A4-size sheet). As shown in FIG. 29, the calculation results were in good agreement with the measured values (correlation coefficient $R^2=0.9745$). It was thus confirmed that the toner counter 600 of the embodiment is capable of determining the toner consumption with high accuracies.

3-5. Fifth Embodiment

A toner counter according to the fifth embodiment determines the toner consumption on the overall page as follows. The amount of toner adherent to the dot portion (equivalent to the area of the dotted portion in FIG. 18) is determined based on the number of toner dots just as in the conventional toner counting technique. The amount of toner adherent to the off-dot portion (equivalent to the area of the cross-hatched portion in FIG. 18) is separately determined. The latter toner adhesion is added to the former toner adhesion.

Figure 30:
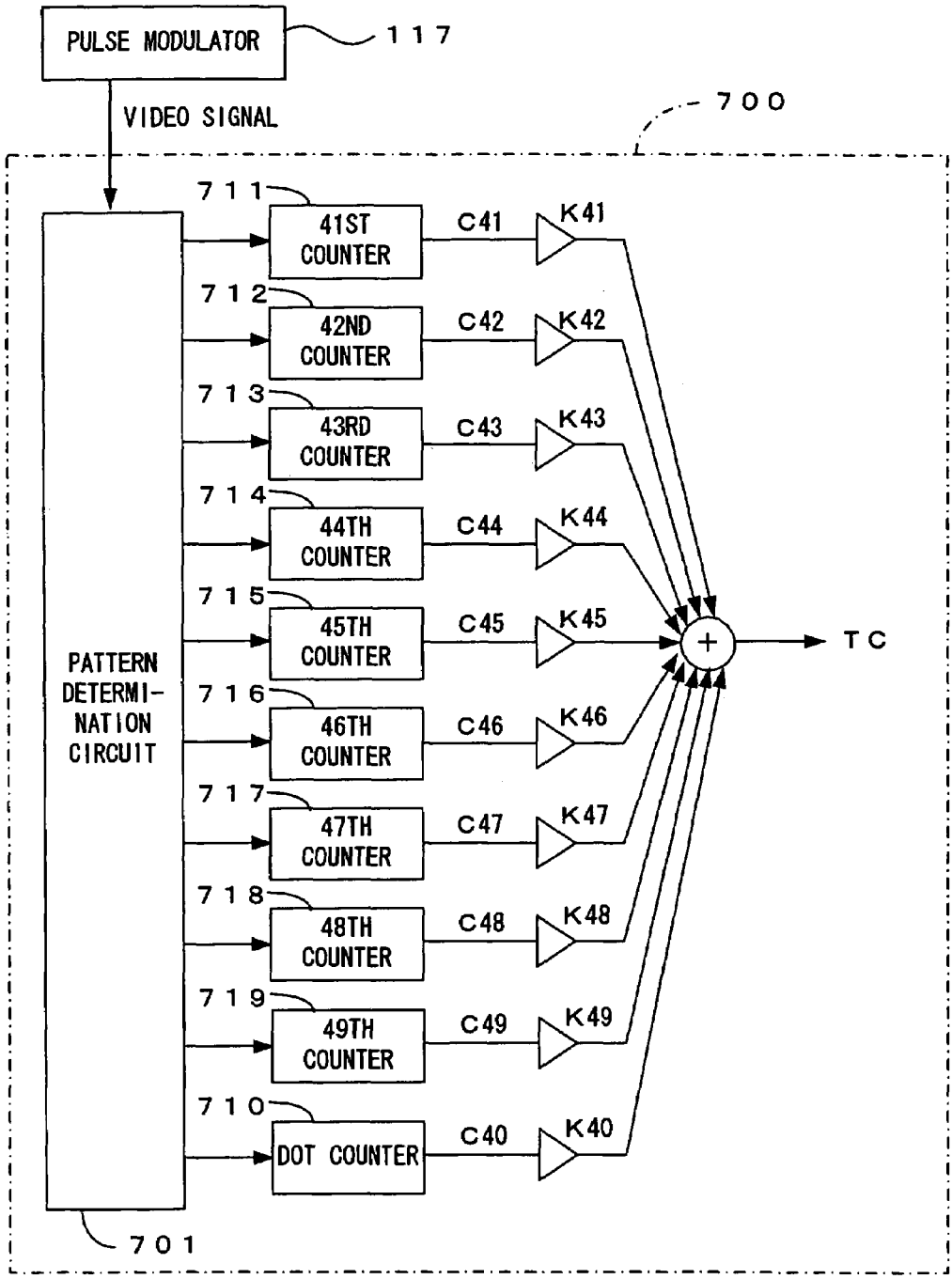
FIG. 30 is a diagram showing the toner counter according to the fifth embodiment of the invention.
Figure 31:
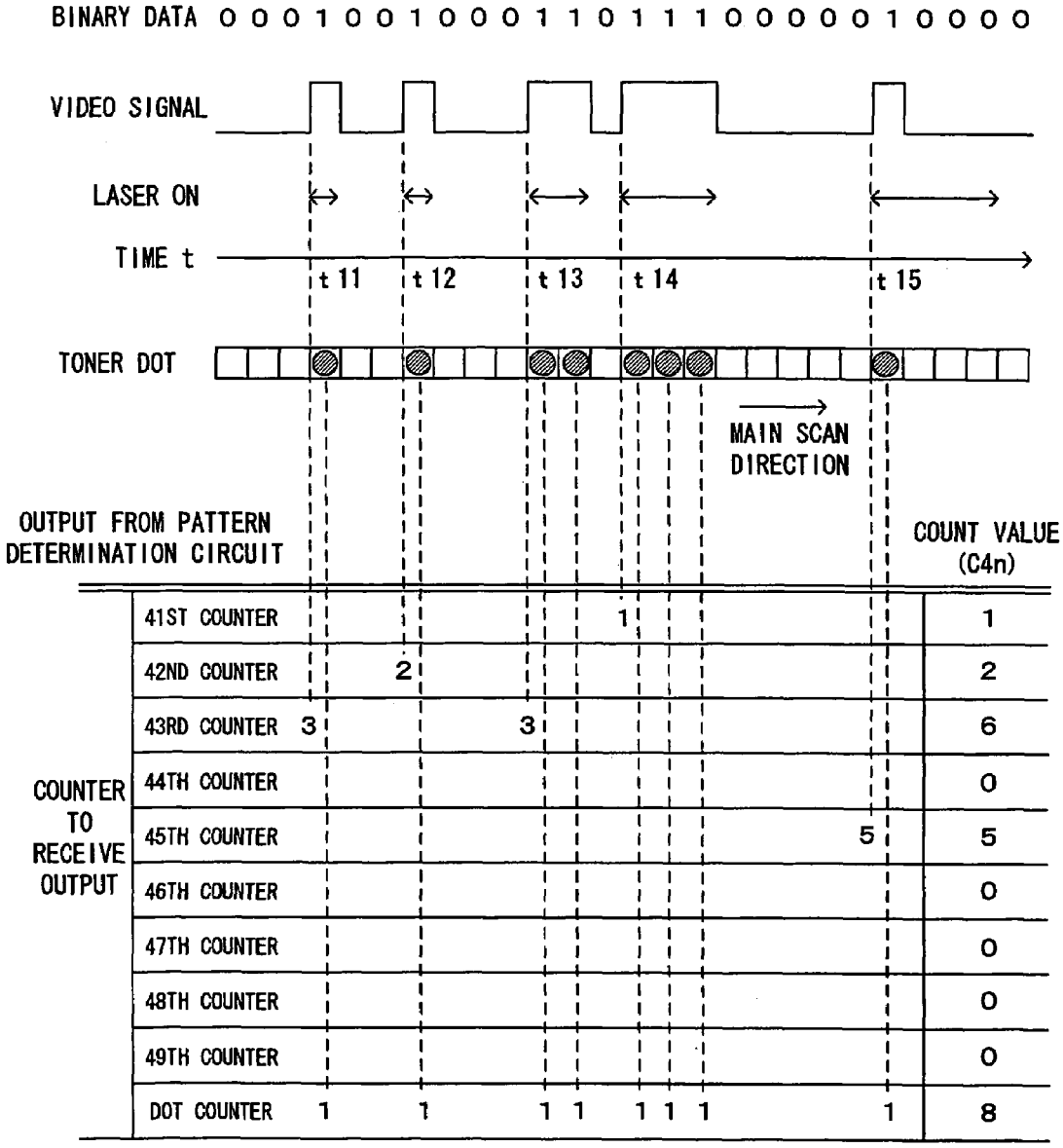
FIG. 31 is a diagram showing operations of the toner counter of the fifth embodiment.

FIG. 30 is a diagram showing the toner counter according to the fifth embodiment of the invention. FIG. 31 is a diagram showing operations of the toner counter of the fifth embodiment. The toner counter 700 of this embodiment is designed to calculate the amount of toner consumed for forming one page of image on a per-toner-color basis. The toner counter 700 includes a pattern determination circuit 701 which determines a dot array on one scan line along the main scan direction based on the video signal outputted from the pulse modulator 117. The toner counter also includes forty-first to forty-ninth counters 711 through 719 for counting a value outputted from the pattern determination circuit 701, and a dot counter 710 for counting the number of toner dots. Specific operations of the pattern determination circuit 701 and the counters 710 through 719 are described with reference to FIG. 31.

The signal outputted from the pulse modulator 117 is a pulse signal shifted between an H-level and an L-level in correspondence to the ON/OFF of the light beam L. The pulse signal is represented herein by binary data in which the H-level has a value 1 whereas the L-level has a value 0. It is assumed that a video signal outputted from the pulse modulator 117 represents a pattern shown in FIG. 31, for example. When a leading edge of a pulse signal or a 0-to-1 shift of the binary data is detected, the pattern determination circuit 701 determines the length of an L-level period just prior to the leading edge or the number of consecutive 0-signals. The circuit outputs the resultant count to any one of the counters 711 through 719 that corresponds to the count value. At time t11 in FIG. 31 when the binary data shifts from 0 to 1, for example, the pattern determination circuit 701 outputs a value 3 to the forty-third counter 713 because three consecutive 0-values are detected just prior to the shift. Similarly, at respective times t12, t13, t14 and t15 when the binary data shifts from 0 to 1, the pattern determination circuit 701 outputs the respective numbers of consecutive 0-values just prior to the shift, or 2, 3, 1 and 5 to the forty-second counter 712, the forty-third counter 713, the forty-first counter 711 and the forty-fifth counter 715. In a case where the number of consecutive 0-values is more than 9, the circuit outputs the number of consecutive 0-values to the forty-ninth counter 719. This operation is repeated in cycles on data on one page of image.

At each appearance of the toner dot, the pattern determination circuit 701 outputs the value 1 to the dot counter 710. Accordingly, the dot counter 710 counts the total number of toner dots on one page. On the other hand, each of the counters 711 through 719 integrates each set of consecutive phantom dots (off-dots) to which the toner is not made to adhere by turning off the laser. A value given by summing up all the count values outputted from the counters 711 through 719 is equal to the number of off-dots on one page. The reason for counting the off-dots based on each set of consecutive off-dots is to deal with the toner adhesion to the toner dots adjoining the off-dots, which is varied according to the mode of the consecutive off-dots, as mentioned supra.

When the dot counting on one page of image is completed, the counters 711 through 719 output their respective count values C40 through C49, as shown in FIG. 30. These count values C40 through C49 are multiplied by coefficients K40 through K49, respectively, the coefficients previously defined according to the respective modes of the consecutive off-dots. All the products are added up to give the sum of the amount of toner adherent to the toner dot portions and the amount of toner adherent to the off-dot portions, or the per-page toner consumption TC. That is, this embodiment calculates the toner consumption TC using the following equation:

$$TC=K40\cdot C40+K41\cdot C41+K42\cdot C42+\ldots+K48\cdot C48+K49\cdot C49 \quad \text{(Equation 5).}$$

In this manner, the embodiment calculates the amount of toner consumed for forming the toner image by adding, as an adjustment value, the toner quantity corresponding to the number of off-dots fundamentally designed not to carry the adherent toner thereon, to the amount of toner adherent to the toner dots. In this process, the number of off-dots is not simply counted but each set of consecutive off-dots is counted and weighted with a predetermined value according to the mode of consecutive off-dots and then, the resultant value is added. That is, the amount of toner to be added based on the number of off-dots is determined according to the mode of consecutive off-dots. Therefore, the above (Equation 5) provides the high-accuracy determination of the toner consumption on the overall page. The coefficients K40 through K49 may be defined in the following manner, for example.

Figure 32:
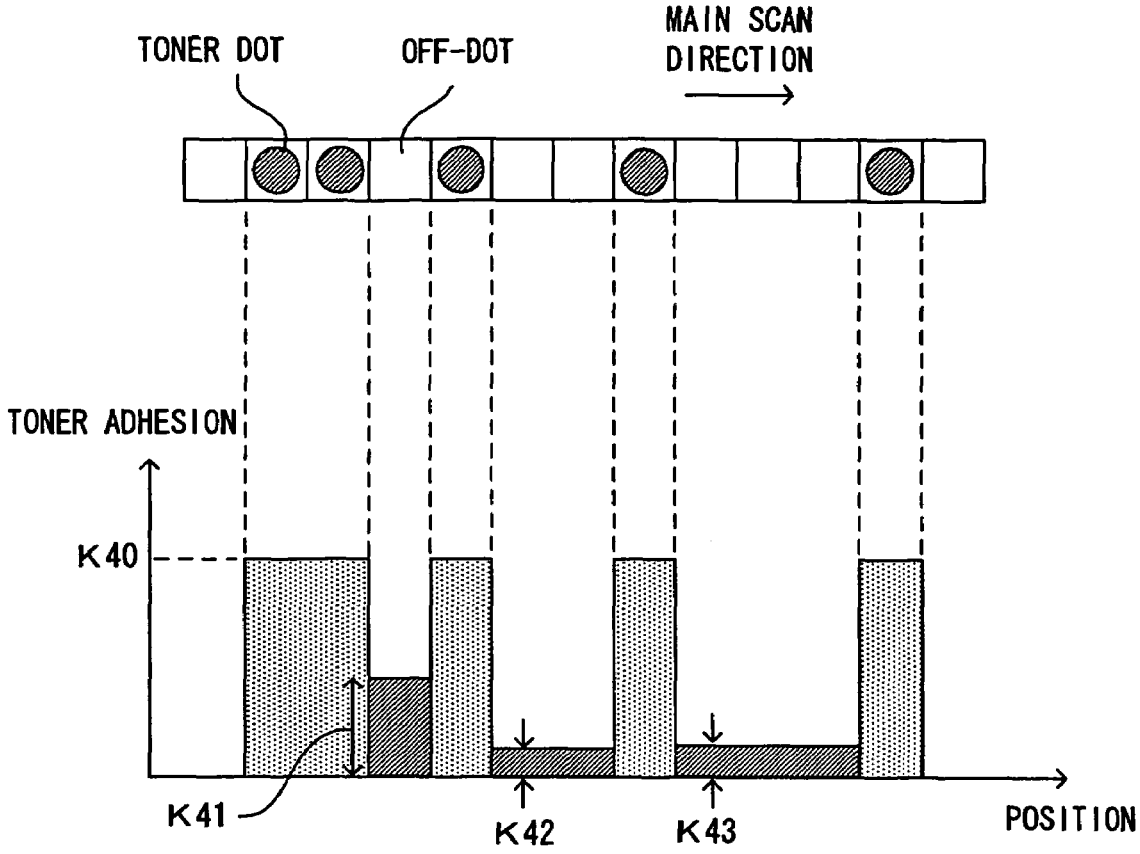
FIG. 32 is a diagram showing how to define the coefficients of the fifth embodiment.

FIG. 32 is a diagram showing how to define the coefficients of the fifth embodiment. It is assumed for example that per-dot toner adhesion amounts empirically determined (or obtained through a proper simulation) are those shown in FIG. 32. Although the toner is inconsistently adhered to the toner dot portion and the off-dot portion as mentioned supra, it may be assumed from a practical viewpoint that the toner is substantially uniformly distributed. Here, a toner adhesion amount of the toner dot portion is equivalent to the coefficient K40. In view of the accuracy, however, it is more preferred to determine the coefficient based on the per-dot toner adhesion on solid image. The per-dot toner adhesion of the off-dot portion consisting of consecutive n off-dots is equivalent to the coefficient K4n(n=1, 2, . . . ).

3-6. Summary of Fourth and Fifth Embodiments

According to the fourth and fifth embodiments of the invention, the toner counter counts the number of toner dots as well as the number of off-dots to which the toner is not made to adhere, and determines the toner consumption on one page of image based on the count values. Thus, the embodiments include the amount of toner adherent to the off-dots in the toner consumption, thereby calculating the toner consumption more accurately than the conventional technique which counts only the number of toner dots. Particularly, each set of consecutive off-dots is discretely counted so as to deal with the varied toner adhesions associated with the different numbers of consecutive off-dots. Hence, the embodiments can determine the toner consumption with higher accuracies.

According to the counter of the fourth embodiment, the coefficient by which the count value of the consecutive off-dots classified by the number thereof is multiplied is equivalent to the sum of the toner adhesion to the off-dots and the toner adhesion to the toner dot formed adjacent to the off-dots. That is, the amount of toner adhered to the off-dot portion is counted in, as added to the amount of toner adhered to the next toner dot. By adopting this approach, the toner counter of the fourth embodiment achieves the high-accuracy determination of the total toner consumption also counting in the amount of toner adhered to the off-dot portion.

The aforementioned toner counter of the fifth embodiment determines the per-page toner consumption by adding the value equivalent to the toner adhesion to the off-dot portion to the toner adhesion to the toner dot portion. Furthermore, the toner adhesion to the off-dot portion is determined based on the off-dot count, which is weighted according to the length of the off-dot portion. Therefore, the toner counter is adapted to determine the toner consumption more accurately than the conventional toner counting technique disregarding the toner adhesion to the off-dot portion.

The toner counters of these embodiments calculate the toner consumption based on the video signal supplied to the laser driver. The pulse width of such a pulse signal provides information directly indicating the sizes of the toner dot or off-dot. Accordingly, the use of such a signal allows the counters to figure out the sizes of the toner dot and off-dots (the number thereof) easily.

Similarly to the foregoing embodiments, these embodiments are also adapted to determine the amount of toner consumed in the overall apparatus accurately by adding the offset value to the above calculation (Equations 4) or (Equation 5). The offset value represents the amount of toner consumed for the other purposes than the image formation.

While the toner counter of the fifth embodiment is designed to add the toner adhesion to the off-dot portion to the toner adhesion to the subsequent toner dot, the toner adhesion to the off-dot portion may be divided between the preceding and the subsequent toner dots. However, this approach involves a rather complicated processing because the coefficients must be classified based on the combination of a length of off-dot(s) precedent to each toner dot and a length of off-dot(s) succeeding thereto and then be defined.

The toner counters of the third through the fifth embodiments take the steps of: counting the number of each set of off-dots classified by the pattern determination circuit; multiplying the count value by the coefficient for each group; and adding up the resultant products. However, the order of calculation steps may be changed such that the output value from the pattern determination circuit is multiplied by the predetermined coefficient while the product is integrated by the counter. This method also gives the same calculation results.

As described above, the engine EG according to the third through the fifth embodiments functions as the "image forming unit" of the invention. The toner counter 500 of the third embodiment, the toner counter 600 of the fourth embodiment and the toner counter 700 of the fifth embodiment each function as the "toner-consumption calculator" and the "toner counter" of the invention. In the foregoing embodiments, the photosensitive member 22 and the exposure unit 6 function as the "latent image carrier" of the invention and as "latent-image forming unit" of the invention, respectively. The video signal outputted from the pulse modulator 117 is equivalent to "image data" of the invention, which indicate the off-dot size.

4-1. Sixth Embodiment

As mentioned supra, the toner adhesion rate is not constant but varies depending upon the sizes of the toner dot portion or the off dot portion. Furthermore, the toner adhesion rate varies depending upon the combinations of the sizes of the toner dot portion and the off dot portion. For instance, the characteristic curve shown in FIG. 6 varies depending upon the sizes of the off dot portion neighboring the toner dot portion of interest. On the other hand, the characteristic curve shown in FIG. 15 varies depending upon the sizes of the toner dot portion of interest. An actual toner image contains the toner dot portions and off dot portions of various sizes which are combined in various ways to form various arrangements. Hence, toner adhesion rates of the individual toner dot portions may take various values depending upon the respective sizes thereof and the sizes of their adjoining off dot portions.

Therefore, a high-accuracy determination of the amount of toner consumed for forming the toner image dictates the need to consider how the toner dot portions and the off dot portions are arranged in individual parts of the toner image. This embodiment calculates the toner consumption as follows.

On the surface of the photosensitive member 22, the toner dot portions and the off dot portions are alternately formed by the scanned light beam L from the exposure unit 6 along the scanning direction (the main scan direction). Provided that one toner dot portion and one off dot portion successively formed along the main scan direction form a pair, it may be said that one image is constituted by plural line images arranged along a direction (the sub-scan direction) perpendicular to the main scan direction as slightly shifted from each other, the line image formed by arranging a plural number of the aforesaid pairs along the main scan direction. As a matter of course, the toner dot portion and off dot portion constituting each pair may have any different sizes and may be combined in any various ways.

An amount of toner consumed for forming each of the plural pairs may be estimated based on a combination of the respective sizes of the toner dot portion and the off dot portion constituting the pair. The estimated values of toner consumptions on the individual pairs on the overall image may be added up. Thus, the amount of toner consumed for forming the overall image may be calculated. More specifically, the toner counter 800 (FIG. 33) to be described as below, for example, may be used to calculate the toner consumption.

Figure 33:
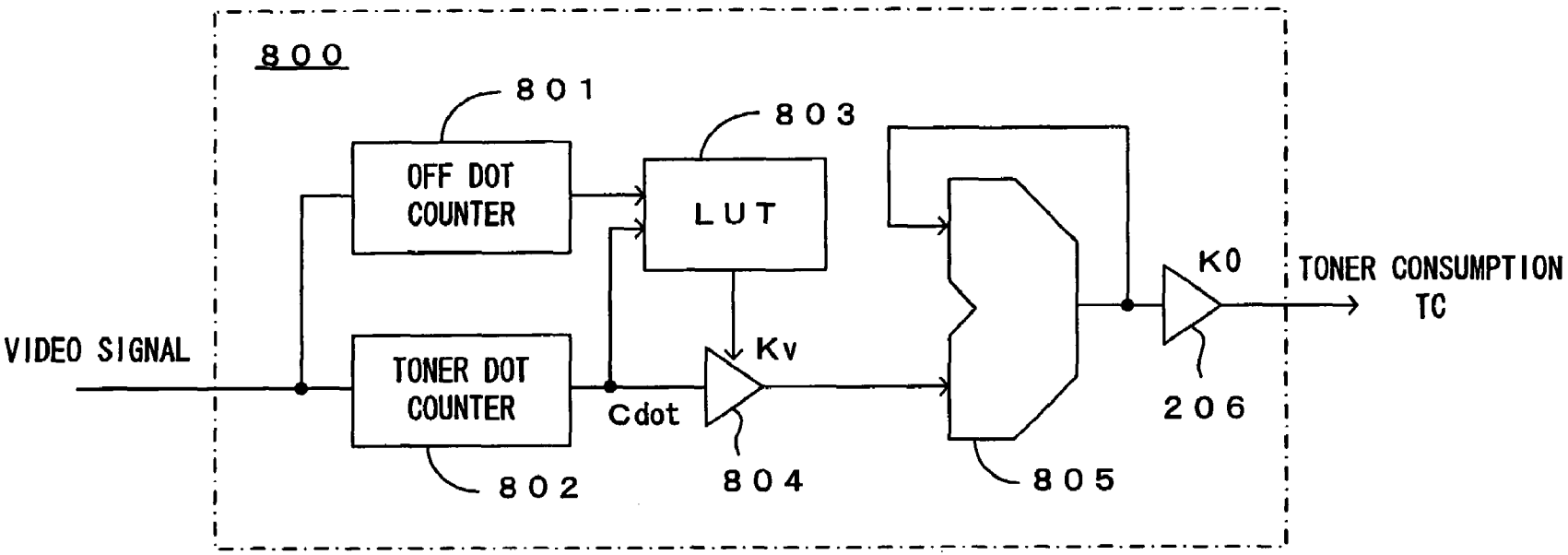
FIG. 33 is a diagram showing a first exemplary construction of the toner counter according to the sixth embodiment.

FIG. 33 is a diagram showing a first exemplary construction of the toner counter according to the sixth embodiment. The toner counter 800 calculates the toner consumption based on the video signal outputted from the pulse modulator 117 of the main controller 11. The video signal is inputted to an off dot counter 801 and a toner dot counter 802 which are provided at the toner counter 800. The off dot counter 801 takes a count of a length of an off dot portion in the main scan direction. Specifically, the off dot counter 801 detects from the input video signal a length of the continued non-irradiation time of the light beam L, converts the length of the time period into the number of unit dots and then, takes a count of the number of the consecutive unit dots. For example, when the off dot counter 801 detects an off dot portion having a length three times the unit dot length, the off dot counter 801 outputs a value 3. On the other hand, the toner dot counter 802 detects a length of the continued irradiation time of the light beam L, converts the length of the time period into the number of unit dots, and takes a count of the number of the consecutive unit dots, thereby taking a count of the length of the toner dot portion.

When the respective sizes of the off dot portion and the toner dot portion of each pair are determined in this manner, reference is made to a look-up table (LUT) 803 based on the resultant values thereby to derive a coefficient Kv. The look-up table 803 stores optional values of the coefficient Kv corresponding to the toner adhesion rate to the pair of interest. A coefficient Kv selected from the look-up table 803 is multiplied by a value Cdot (equivalent to the length of the toner dot portion) outputted from the toner dot counter 802 by means of a multiplier 804. The product is inputted to an accumulator 805. The accumulator 805 adds a value stored therein and the output value from the multiplier 804, and then stores therein the resultant sum. In the toner counter 800, the value obtained by multiplying the count value Cdot from the toner dot counter 802 by the coefficient Kv selected from the look-up table is integrated by means of the accumulator 805. Then, an integration value obtained by performing the integration on one-page image data is multiplied by the coefficient K0 equivalent to the toner adhesion rate of solid image by means of a multiplier 806. Thus is obtained a toner consumption TC on one page of image. That is, the embodiment calculates the toner consumption TC using the following equation:

$$TC=K0\cdot\Sigma(Kv\cdot Cdot) \quad \text{(Equation 6)}$$

According to the embodiment, the size of the toner dot portion is weighted according to the size thereof and the size of its adjoining off dot portion and the resultant value is integrated. The resultant integration value is multiplied by a constant toner adhesion rate thereby to determine the toner consumption. The weight to be imparted is designed to be increased as the toner adhesion rate increases. Hence, calculation errors are corrected by weighting in this manner, the calculation errors resulting from the toner adhesion rate differing from one combination of the sizes of the toner dot portion and its adjoining off dot portion to another size combination. Thus, the calculation accuracy is increased.

FIG. 34 is a chart showing one example of contents of the look-up table. In this chart, the size of the toner dot portion is represented by the number of consecutive toner dots, whereas the size of the off dot portion is represented by the number of consecutive off dots. A value in a cell at an intersection of a row corresponding to the number of consecutive off dots counted by the off dot counter 801 and a column corresponding to the number of consecutive toner dots counted by the toner dot counter 802 is used as the coefficient Kv of interest. In a case where a count of the consecutive toner dots is 1 whereas a count of the consecutive off dots is 10 (a 1-on 10-off image is formed in this case), for example, a value of the coefficient Kv corresponding to this value combination is at 1.62. In a case where a count of the consecutive toner dots is 3 whereas a count of the consecutive off dots is 2 (a 3-on 2-off image is formed in this case), for example, a value of the coefficient Kv corresponding to this value combination is at 1.09.

In a case where a count of the consecutive off dots is 0 not shown in the chart of FIG. 34, it indicates that one scan line contains no off dot or the toner dots completely fills the line. Therefore, a value of the coefficient Kv in this case is at 1.00. In a case where a count of the consecutive toner dots is 0, it indicates that the scan line consists of off dots. Hence, a value of the coefficient Kv in this case is at 0 (Since a count value Cdot given by the toner dot counter 802 is at zero, the coefficient Kv may practically take any value).

As mentioned supra, the look-up table 803 stores the optional values of the coefficient Kv by which the count value Cdot from the toner dot counter 802 is multiplied, while any one of the optional values is selected based on the size of the toner dot portion and that of its adjoining off dot portion. These optional values are obtained as follows. Toner adhesion rates relating to various combinations of the sizes of the toner dot portion and the off dot portion are previously determined from actual measurement values or through simulation (see FIG. 6 and FIG. 15), and are individually normalized using the toner adhesion rate K0 of solid image.

Figure 35:
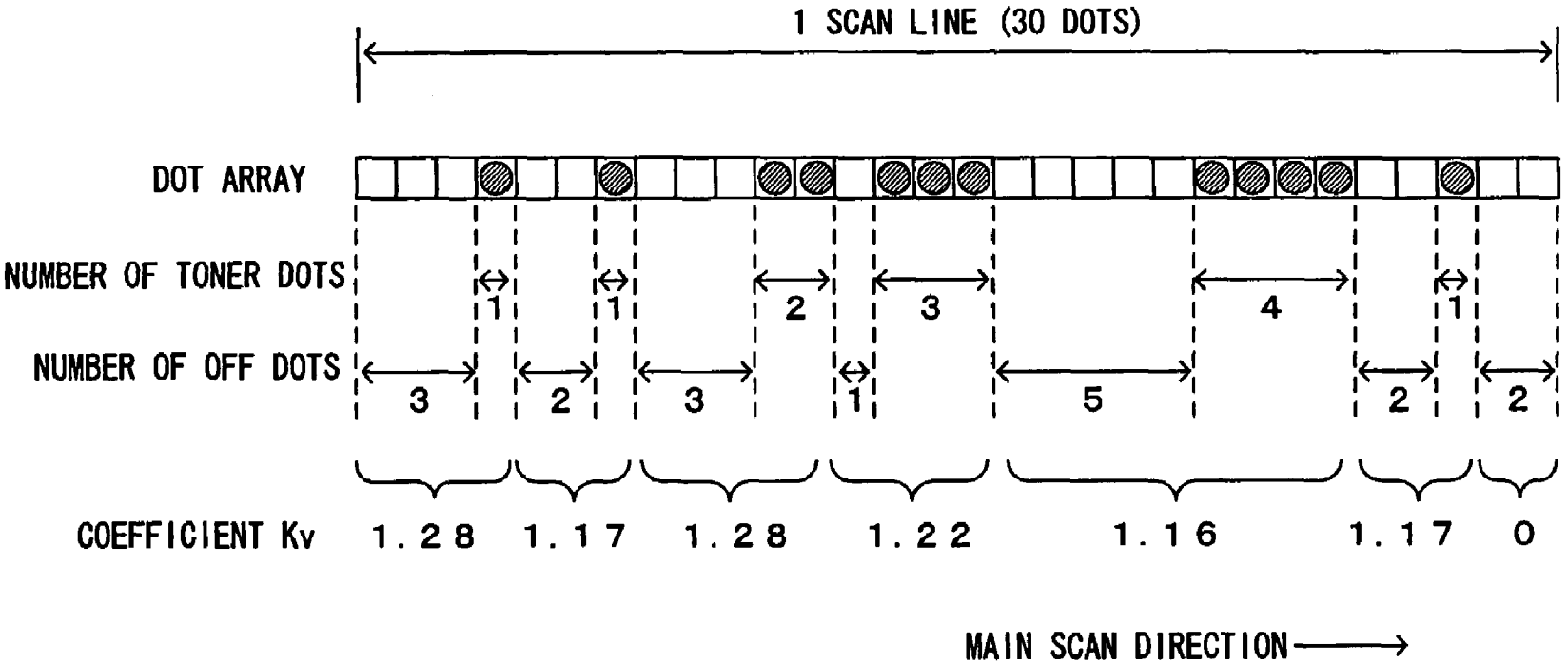
FIG. 35 is a diagram showing a specific example of calculation performed by the toner counter according to the sixth embodiment.

FIG. 35 is a diagram showing a specific example of calculation performed by the toner counter according to the sixth embodiment. It is assumed here that one scan line consists of 30 dots. In a column of "dot array", a cell with a cross-hatched circle indicates a toner dot whereas a blank cell indicates an off dot. Provided that a dot array in one scan line is arranged as shown in the figure, three consecutive off dots antecede a single toner dot in this line. A coefficient Kv corresponding to this pair is decided as 1.28 by making reference to the look-up table 803 based on a count 3 of the consecutive off dots and a count 1 of the consecutive toner dots.

Subsequently, two consecutive off dots are followed by a single toner dot. Therefore, a coefficient Kv corresponding to this pair is at 1.17. Coefficients Kv for the individual succeeding pairs of the off dot portion and the toner dot portion may be determined the same way.

The coefficient Kv thus determined for each of the pairs is multiplied by the number of consecutive dots of the toner dot portion constituting the pair. The individual products are added up to give a value 14.48. When the number of toner dots constituting the line is simply counted, the resultant count is 12. However, this value does not reflect the states of the toner dot arrays at all. Therefore, an accurate value of toner consumption cannot be obtained by multiplying this value (12) by a per-dot toner adhesion rate. In contrast, a value calculated according to the embodiment is based on "the weighted number of toner dots" counting in the toner dot arrays and the toner adhesion rates corresponding thereto. Therefore, the toner consumption may be calculated more accurately by multiplying the weighted value by the toner adhesion rate K0.

Figure 36:
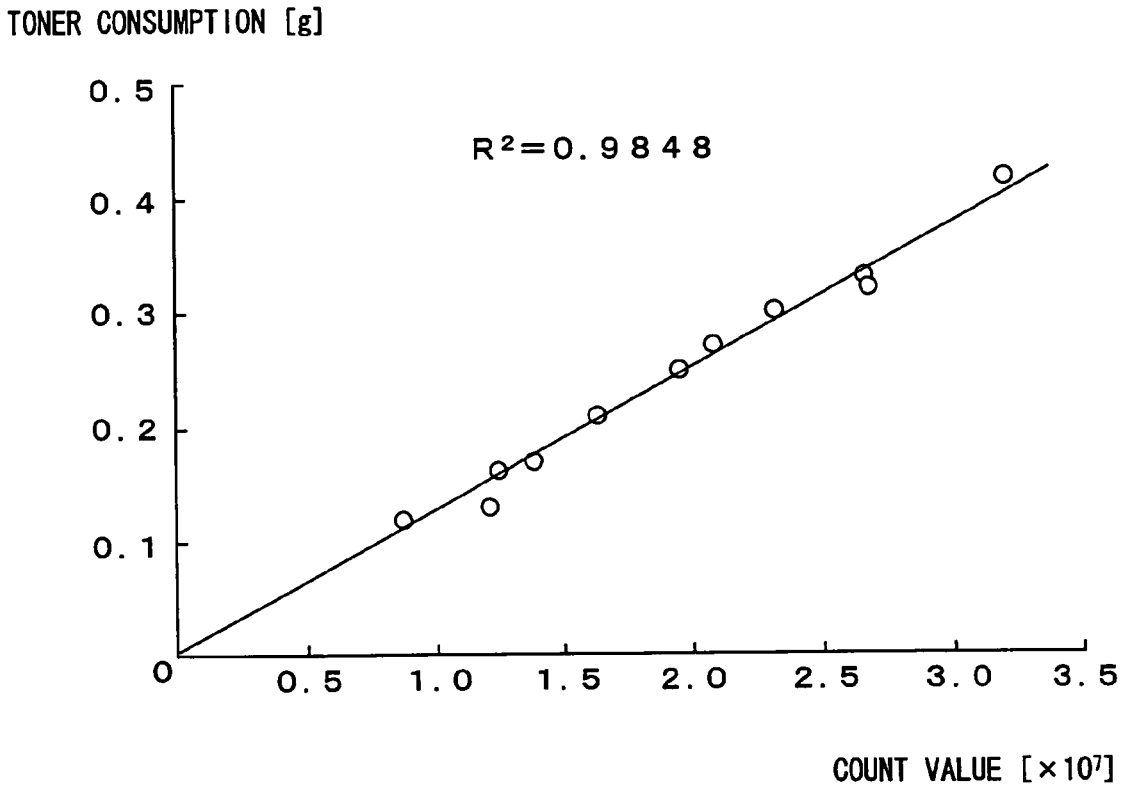
FIG. 36 is a graph showing the calculation results given by the toner counter of the sixth embodiment.

FIG. 36 is a graph showing the calculation results given by the toner counter of the sixth embodiment. In FIG. 36, the count value integrated by an accumulator 803 is plotted on the abscissa, whereas the measured toner consumption corresponding to the integrated count value is plotted on the ordinate. The integrated count value is obtained by forming images of various types and integrating count values of each of the images. As shown in FIG. 36, there is achieved a favorable proportional relation (correlation coefficient $R^2$=0.9848) between the count value given by the accumulator 803 and the actual value of the toner consumption. It is thus demonstrated that the toner counter 800 of the embodiment is capable of calculating the toner consumption with high accuracies.

4-2. Modification of Sixth Embodiment

Figure 37:
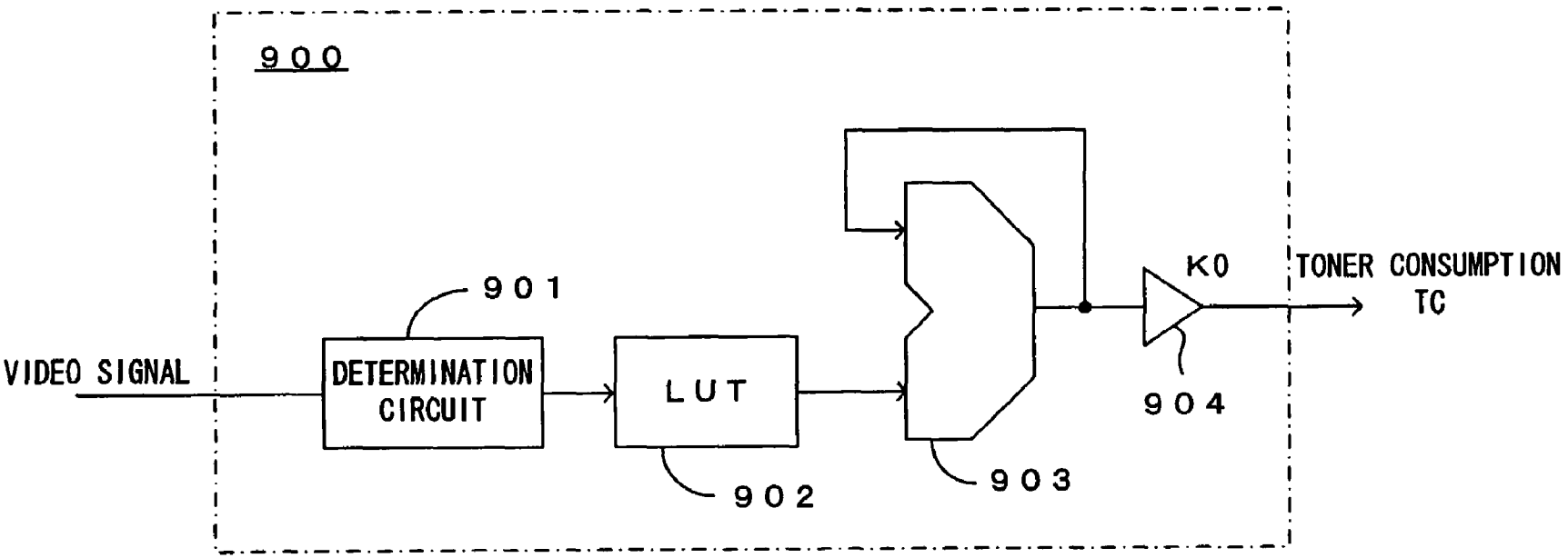
FIG. 37 is a diagram showing another exemplary construction of the toner counter according to the sixth embodiment.

FIG. 37 is a diagram showing another exemplary construction of the toner counter according to the sixth embodiment. The toner counter 900 shown in FIG. 37 is constructed essentially based on the same concept as that of the aforementioned toner counter 800 (FIG. 33). Such a construction is also adapted to determine the toner consumption as accurately as the aforementioned toner counter 800. In the toner counter 900, the video signal outputted from the main controller 10 is inputted to a determination circuit 901. A function of the determination circuit 901 is resemblant to a combination of the functions of the off dot counter 801 and the toner dot counter 802 provided at the toner counter 800. Specifically, the determination circuit 901 determines from the input video signal the respective sizes of the paired off dot portion and toner dot portion formed in succession. By way of example of the first pair shown in FIG. 35, the off dot portion has a size of 3 dots whereas the toner dot portion has a size of 1 dot.

Reference is made to a look-up table 902 based on the results. Optional values stored in the look-up table 902 differ from those of the table 803 in the aforesaid toner counter 800. The optional value is determined by normalizing an estimated amount of toner consumed for forming the pair of interest using the toner adhesion rate K0. The optional value is equivalent to a product given by multiplying each of the optional values for the coefficient Kv shown in FIG. 34 by a size of a corresponding toner dot portion. A toner consumption on each of the pairs to be formed is retrieved from the table 902 and integrated by the accumulator 903. In the meantime, a multiplier 904 multiplies the resultant integration value by the toner adhesion rate K0, so as to determine the overall toner consumption TC. These toner counters 800 and 900 may also be adapted to add a predetermined offset value to the toner consumption TC calculated in the aforementioned manners.

4-3. Summary of Sixth Embodiment

As described above, the sixth embodiment determines the amount of toner consumed for forming the toner image based on the sizes of the toner dot portions and the off dot portions which constitute the toner image. More specifically, the amount of toner consumed for forming each paired toner dot portion and off dot portion is estimated according to the combination of the sizes of the toner dot portion and the off dot portion so paired. The resultant estimated values are integrated to obtain the toner consumption on the overall toner image which is an assembly of these toner dot portions and off dot portions. By adopting this method, the toner consumption can be determined more accurately than by using the conventional toner counting techniques.

Specifically, the toner consumption is estimated as follows. There are previously determined the values individually corresponding to the toner adhesion rates for the individual combinations of the sizes of the adjoining off dot portion and toner dot portion. The values thus determined are listed in the table. The sizes of the paired off dot portion and toner dot portion are detected from the video signal. Based on the combination of the detected sizes, reference is made to the table so that the toner consumption on the pair of interest is estimated. By taking this procedure, the toner consumption on any toner image constituted by the toner dot portions and off dot portions having various sizes and arranged in various ways can be calculated accurately. Furthermore, a simple arrangement may be used to calculate the toner consumption.

According to the foregoing embodiment as described above, the engine EG functions as an "image forming unit" of the invention. Both of the toner counter 800 and the toner counter 900 function as a "toner-consumption calculator" and a "toner counter" of the invention. According to the foregoing embodiment, the photosensitive member 22 and the exposure unit 6 function as a "latent image carrier" and a "latent-image forming unit" of the invention, respectively. The video signal outputted from the pulse modulator 117 is equivalent to "image data" of the invention.

It is to be noted that the invention is not limited to the foregoing embodiments and various changes and modifications than the above may be made thereto unless such changes and modifications depart from the scope of the invention. For instance, the foregoing embodiment use per-page image data for calculating the amount of toner consumed for forming the image on the page. Alternatively, the calculation may be made based on another unit time period, such as a unit-job period or a day period.

According to the toner counter of the above embodiment, the toner consumption is calculated by multiplying the integration value outputted from the accumulator by the coefficient K0 equivalent to the toner adhesion rate. However, the toner counter may accomplish the same function by multiplying the output value from the table by the coefficient K0, and integrating the resultant product. If the optional value stored in the table is expressed in terms of toner adhesion rate, the step of multiplying the coefficient K0 may be omitted.

The foregoing embodiment expresses the sizes (the length with respect to the main scan direction) of the toner dot portion and the off dot portion based on the number of unit dots. However, the actual toner dot portion or the off dot portion can be varied in size based on a smaller unit than the size of the unit dot by increasing or decreasing the irradiation time (the non-irradiation time) of the light beam L. Therefore, the size of the toner dot portion or the off dot portion is not always an integral multiple of the unit dot size, but may possibly take a value of say 0.5 dots or 1.5 dots. The invention is also applicable to such cases (In fact, the graphs of FIG. 6 and FIG. 15 include the experimental results relating to the sizes which are not integral multiples of the unit dot). In this case, the sizes listed in the table may be varied in smaller steps or the sizes may be classified range by range.

The foregoing embodiment assumes a pair consisting of one toner dot portion and one off dot portion adjacent thereto, and determine the amount of toner adherent to an area corresponding to the pair. However, one toner dot portion is normally sandwiched between two off dot portions. In order to further increase the calculation accuracy, therefore, it is more desirable to determine the amount of toner adherent to the toner dot portion of interest based on the size of the toner dot portion and the sizes of the two off dot portions adjacent thereto. In a case where this approach is adopted, however, a fear exists that the data to be stored in the look-up table is huge in volume.

5. Apparatuses to Which the Invention is Applicable

The image forming apparatuses according to the foregoing embodiments are those of the so-called "non-contact development system" wherein the photosensitive member 22 is disposed in face-to-face relation with the developing roller 44 via the gap therebetween. While the inventive calculation method of toner consumption affords a particularly noticeable effect to such apparatuses, an apparatus of the "contact development system" may also adopt the inventive method for achieving the increased accuracies of the toner consumption calculation, the apparatus wherein the photosensitive member 22 and the developing roller 44 are in contact with each other.

The invention is not limited to the foregoing embodiments and is also applicable to, for example, an apparatus including only a developer for a black toner for forming a monochromatic image, an apparatus including a transfer medium (such as a transfer drum, or a transfer sheet) other than the intermediate transfer belt, and other image forming apparatuses such as copiers and facsimile machines.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

an image forming unit which forms a toner image by visualizing an electrostatic latent image with a toner; and a toner-consumption calculator which calculates an amount of toner consumed by the image forming unit by integration of toner consumption for forming each toner dot portion which is a sub-assembly of consecutive toner dots included in the electrostatic latent image and distant from the other toner dot portions and to which the toner is made to adhere, wherein the toner-consumption calculator calculates the toner consumption for forming each toner dot portion based on a size of each toner dot portion and a toner adhesion characteristic which is determined previously and represents a toner adhesion amount corresponding to each of sizes of toner dot portions.

2. An image forming apparatus according to claim 1, wherein the toner-consumption calculator calculates the amount of toner consumed for visualizing the toner dot portion by multiplying a value of dot information on the size of the toner dot portion by a coefficient defined based on the value of dot information and the toner adhesion characteristic.

3. An image forming apparatus according to claim 2, wherein the image forming unit comprises a latent image carrier which has its surface formed from a photosensitive material so as to be capable of carrying thereon the electrostatic latent image, and an exposure unit which irradiates a light beam on the surface of the latent image carrier, and forms the electrostatic latent image on the surface of the latent image carrier by scanning the light beam on a region of the surface of the latent image carrier that corresponds to the toner dot portion, and wherein the dot information represents an irradiation time of the light beam irradiated from the exposure unit onto a region of the latent image carrier corresponding to the toner dot portion.

4. An image forming apparatus according to claim 2, further comprising a signal processor which generates a multivalued signal relating to a toner dot portion to be formed by processing an image signal, and outputs the multivalued signal to the image forming unit, wherein the dot information is represented by the multivalued signal corresponding to the toner dot portion.

5. An image forming apparatus according to claim 2, wherein the toner-consumption calculator classifies the size of the toner dot portion into plural groups and defines the coefficient to each group respectively, and the sizes are finely classified in a region where the toner adhesion characteristic varies relatively greatly but are roughly classified in a region where the toner adhesion characteristic varies less.

6. An image forming apparatus according to claim 1, wherein the image forming unit comprises a latent image carrier capable of carrying thereon the electrostatic latent image, and a toner carrier disposed in face-to-face relation with the latent image carrier via a predetermined gap therebetween and carrying the toner on its surface, and forms the toner image by transferring the toner from the toner carrier to the latent image carrier.

7. An image forming apparatus according to claim 1, wherein the toner-consumption calculator integrates a toner consumption on each of the toner dot portions visualized by the image forming unit during a predetermined time period, and thereby calculates an amount of toner consumed during the time period.

8. An image forming apparatus according to claim 7, wherein the amount of toner consumed by the apparatus during the time period is calculated by adding an offset value based on use conditions of the apparatus to the integration value.

9. An image forming apparatus comprising:

an image forming unit which forms a toner image by visualizing an electrostatic latent image with a toner; and a toner-consumption calculator which calculates an amount of toner consumed by the image forming unit by integration of toner consumption for forming each toner dot portion which is a subassembly of consecutive toner dots included in the electrostatic latent image and distant from the other toner dot portions and to which the toner is made to adhere, wherein the toner-consumption calculator calculates an amount of toner consumed for forming each toner dot portion by multiplying a value of dot information corresponding to a size of the toner dot portion by a predetermined coefficient, and wherein the coefficient is defined based on a previously determined relation between a size of a toner dot portion and a toner adhesion amount to the toner dot portion and according to the dot information.

10. An image forming apparatus according to claim 9, wherein the image forming unit comprises a latent image carrier which has its surface formed from a photosensitive material so as to be capable of carrying thereon the electrostatic latent image, and an exposure unit which irradiates a light beam on the surface of the latent image carrier, and forms the electrostatic latent image on the surface of the latent image carrier by scanning the light beam on a region of the surface of the latent image carrier that corresponds to the toner dot portion, and wherein the dot information represents an irradiation time of the light beam irradiated from the exposure unit onto a region of the latent image carrier corresponding to the toner dot portion.

11. An image forming apparatus according to claim 9, further comprising a signal processor which generates a multivalued signal relating to a toner dot portion to be formed by processing an image signal, and outputs the multivalued signal to the image forming unit, wherein the dot information is represented by the multivalued signal corresponding to the toner dot portion.

* * * * *